US010989070B2

(12) United States Patent
VanTassel et al.

(10) Patent No.: US 10,989,070 B2
(45) Date of Patent: Apr. 27, 2021

(54) SHROUD FOR GAS TURBINE ENGINE

(71) Applicant: General Electric Company, Schenectady, NY (US)

(72) Inventors: Brad Wilson VanTassel, Easley, SC (US); Evan Andrew Sewall, Greer, SC (US); Joseph Anthony Weber, Simpsonville, SC (US); Travis J Packer, Simpsonville, SC (US); Joseph Daniel Franzen, Jr., West Chester, OH (US); Bryan David Lewis, Greenville, SC (US)

(73) Assignee: General Electric Company, Schenectady, NY (US)

( * ) Notice: Subject to any disclaimer, the term of this patent is extended or adjusted under 35 U.S.C. 154(b) by 157 days.

(21) Appl. No.: 15/995,072

(22) Filed: May 31, 2018

(65) Prior Publication Data

US 2019/0368377 A1 Dec. 5, 2019

(51) Int. Cl.
*F01D 5/22* (2006.01)
*F01D 25/14* (2006.01)
(Continued)

(52) U.S. Cl.
CPC ..... *F01D 25/14* (2013.01); *F01D 5/225* (2013.01); *F01D 9/041* (2013.01); *F01D 9/065* (2013.01);
(Continued)

(58) Field of Classification Search
CPC ..... F01D 11/08; F01D 11/24; F01D 11/005; F01D 25/12; F01D 25/14; F01D 5/225;
(Continued)

(56) References Cited

U.S. PATENT DOCUMENTS 5,375,973 A * 12/1994 Sloop ..... F01D 11/08 415/115
5,486,090 A * 1/1996 Thompson ..... F01D 11/08 415/173.1
(Continued)

FOREIGN PATENT DOCUMENTS

EP 0694677 A1 1/1996
EP 2184446 A2 5/2010
EP 2894301 A1 7/2015

OTHER PUBLICATIONS

General Electric Company; International Patent Application No. PCT/US2019/033261; International Search Report; dated Aug. 13, 2019; (2 pages).

*Primary Examiner* — Brian P Wolcott
*Assistant Examiner* — Behnoush Haghighian
(74) *Attorney, Agent, or Firm* — Dority & Manning, P.A.

(57) ABSTRACT

A turbine having a stationary shroud ring formed about rotor blades. The stationary shroud ring may include an inner shroud segment. The inner shroud segment may include a cooling configuration that includes a crossflow channel. The crossflow channel may extend lengthwise between an upstream end and a downstream end, and, therebetween, include a junction point that divides the crossflow channel lengthwise into upstream and downstream sections, with the upstream section extending between the upstream end and the junction point, and the downstream section extending between the junction point and the downstream end. The crossflow channel may have a cross-sectional flow area that varies lengthwise such that a cross-sectional flow area of the upstream section decreases between the upstream end and the junction point, and a cross-sectional flow area of the downstream section increases between the junction point and the downstream end.

20 Claims, 14 Drawing Sheets

(51) Int. Cl.

| | |
|---|---|
| ***F01D 9/04*** | (2006.01) |
| ***F01D 9/06*** | (2006.01) |
| ***F01D 25/12*** | (2006.01) |
| *F01D 11/08* | (2006.01) |
| *F01D 11/00* | (2006.01) |
| *F01D 11/24* | (2006.01) |

(52) U.S. Cl.
CPC ..... *F01D 25/12* (2013.01); *F01D 11/005* (2013.01); *F01D 11/08* (2013.01); *F01D 11/24* (2013.01); *F05D 2240/11* (2013.01); *F05D 2240/14* (2013.01); *F05D 2240/81* (2013.01); *F05D 2260/205* (2013.01)

(58) Field of Classification Search
CPC ..... F01D 9/04; F01D 9/041; F01D 25/246; F01D 5/186; F01D 5/187; F05D 2240/11; F05D 2260/201; F05D 2260/202; F05D 2260/204; F05D 2240/81
See application file for complete search history.

(56) References Cited

U.S. PATENT DOCUMENTS 5,538,393 A * 7/1996 Thompson ..... F01D 11/08 415/115
6,241,467 B1 * 6/2001 Zelesky ..... F01D 9/04 415/115
6,254,347 B1 * 7/2001 Shaw ..... B23H 9/10 416/97 R
6,280,140 B1 * 8/2001 Soechting ..... F01D 5/184 416/97 R
6,340,285 B1 * 1/2002 Gonyou ..... F01D 11/005 415/116
6,412,268 B1 * 7/2002 Cromer ..... F01D 9/023 60/760
6,539,627 B2 * 4/2003 Fleck ..... F01D 5/187 29/889.7
6,582,584 B2 * 6/2003 Lee ..... B23H 9/00 205/640
6,923,623 B2 * 8/2005 Cleveland ..... F01D 5/141 416/92
7,284,954 B2 * 10/2007 Parker ..... F01D 11/08 415/173.1
7,306,424 B2 * 12/2007 Romanov ..... F01D 11/08 415/115
7,448,850 B2 * 11/2008 Bulgrin ..... F01D 25/12 415/173.1
7,553,128 B2 * 6/2009 Abdel-Messeh ..... F01D 5/187 415/116
7,670,108 B2 * 3/2010 Liang ..... F01D 11/005 415/115
7,988,410 B1 * 8/2011 Liang ..... F01D 9/04 415/115
8,128,344 B2 * 3/2012 McGovern ..... F01D 11/08 415/116
8,177,492 B2 * 5/2012 Knapp ..... F01D 5/18 415/173.1
8,727,704 B2 * 5/2014 Lee ..... F01D 11/08 415/116
9,017,012 B2 * 4/2015 Brunelli ..... F01D 25/12 415/115
9,279,330 B2 * 3/2016 Xu ..... F01D 5/186
9,464,538 B2 * 10/2016 Sezer ..... F01D 11/24
9,757,936 B2 * 9/2017 Lacy ..... B22F 3/1055
9,822,654 B2 * 11/2017 Brandl ..... F01D 9/065
10,221,719 B2 * 3/2019 Benjamin ..... F01D 9/04
10,233,775 B2 * 3/2019 Bunker ..... F01D 5/186
10,309,252 B2 * 6/2019 Benjamin ..... F01D 9/00
10,378,380 B2 * 8/2019 Benjamin ..... F01D 25/246
10,443,437 B2 * 10/2019 Lacy ..... F01D 11/08
10,502,093 B2 * 12/2019 Synnott ..... F01D 25/12
10,533,454 B2 * 1/2020 Synnott ..... F01D 5/225
10,533,749 B2 * 1/2020 Sreekanth ..... F23R 3/005
2010/0111671 A1 * 5/2010 McGovern ..... F01D 11/08 415/115
2014/0161625 A1 * 6/2014 Zhang ..... F01D 5/187 416/96 R
2014/0360155 A1 * 12/2014 Weber ..... F01D 5/187 60/39.83
2015/0007581 A1 * 1/2015 Sezer ..... F01D 11/24 60/806
2015/0013345 A1 * 1/2015 Porter ..... F01D 11/24 60/806
2015/0110612 A1 * 4/2015 Brandl ..... F01D 9/065 415/178
2016/0237852 A1 * 8/2016 Romanov ..... F01D 25/12
2016/0273363 A1 * 9/2016 Bunker ..... F01D 9/065
2017/0175575 A1 * 6/2017 Benjamin ..... F01D 9/04
2017/0260873 A1 * 9/2017 Lacy ..... F01D 11/08

* cited by examiner

SHROUD FOR GAS TURBINE ENGINE

BACKGROUND OF THE INVENTION

The subject matter disclosed herein relates to hot gas path components within the turbine of a gas turbine engine, and, more specifically, but not by way of limitation, to the interior structure and cooling configuration of stationary shrouds formed about turbine rotor blades.

Gas turbine engines include compressor and turbine sections in which rows of blades are axially stacked in stages. Each stage typically includes a row of circumferentially-spaced stator blades, which are fixed, and a row of rotor blades, which rotate about a central turbine axis or shaft. In operation, generally, the compressor rotor blades are rotated about the shaft, and, acting in concert with the stator blades, compress a flow of air. This supply of compressed air then is used within a combustor to combust a supply of fuel. The resulting flow of hot expanding combustion gases, which is often referred to as working fluid, is then expanded through the turbine section of the engine. Within the turbine, the working fluid is redirected by the stator blades onto the rotor blades so to power rotation. Stationary shrouds may be constructed about the rotor blades to define a boundary of the hot gas path. The rotor blades are connected to a central shaft such that the rotation of the rotor blades rotates the shaft, and, in this manner, the energy of the fuel is converted into the mechanical energy of the rotating shaft, which, for example, may be used to rotate the rotor blades of the compressor, so to produce the supply of compressed air needed for combustion, as well as, rotate the coils of a generator so to generate electrical power. During operation, because of the high temperatures, velocity of the working fluid, and rotational velocity of the engine, many of the components within the hot gas path become highly stressed by extreme mechanical and thermal loads.

Many industrial applications, such as those involving power generation and aviation, still rely heavily on gas turbine engines, and because of this, the design of more efficient engines is an ongoing objective. Even incremental advances in machine performance, efficiency, or cost-effectiveness are meaningful in the competitive markets that have evolved around this technology. While there are several known strategies for improving the efficiency of gas turbines—for example, increasing the size of the engine, firing temperatures, or rotational velocities—each generally places additional strain on hot gas path components that are already highly stressed. As a result, there remains a general need for improved apparatus, methods or systems for alleviating such stresses or, alternatively, enhancing the durability of such components so they may better withstand them. For example, the extreme temperatures of the hot gas path stress the stationary shrouds formed about the rows of rotor blades, causing degradation and shortening the useful life of the component. Novel shroud designs are needed that optimize coolant and sealing efficiency, while also being cost-effective to construct, durable, and flexible in application.

BRIEF DESCRIPTION OF THE INVENTION

The present application describes a turbine having a stationary shroud ring formed about rotor blades. The stationary shroud ring may include an inner shroud segment. The inner shroud segment may include a cooling configuration that includes a crossflow channel. The crossflow channel may extend lengthwise between an upstream end and a downstream end, and, therebetween, include a junction point that divides the crossflow channel lengthwise into upstream and downstream sections, with the upstream section extending between the upstream end and the junction point, and the downstream section extending between the junction point and the downstream end. The crossflow channel may have a cross-sectional flow area that varies lengthwise such that a cross-sectional flow area of the upstream section decreases between the upstream end and the junction point, and a cross-sectional flow area of the downstream section increases between the junction point and the downstream end.

BRIEF DESCRIPTION OF THE DRAWINGS

These and other features of this disclosure will be more completely understood and appreciated by careful study of the following more detailed description of exemplary embodiments of the disclosure taken in conjunction with the accompanying drawings, in which.

DETAILED DESCRIPTION OF THE INVENTION

The present disclosure is directed to systems and methods for configuring and cooling components of a turbine, specifically, an inner shroud segment, disposed along a hot gas path. As will be seen, the inner shroud segment of the present invention includes an internal cooling configuration (or "cooling configuration") in which particular channels are formed within the interior of the inner shroud segment.

As used herein, "downstream" and "upstream" are terms that indicate a flow direction of a fluid through a channel or passage. Thus, for example, relative to the flow of working fluid through the turbine, the term "downstream" refers to a direction that generally corresponds to the direction of the flow, and the term "upstream" generally refers to the direction that is opposite of the direction of flow. The term "radial" or "radial direction" refers to movement or position perpendicular to a center line or axis. In relation to this, it may be necessary to describe components that reside at differing radial positions with regard to an axis. As used herein, a first component may be described as being "above" or "raised" or "elevated" in relation to a second component if the first component's radial position is further from the axis than the second component's. Alternatively, if the first component resides further from the axis than the second component, it may be stated herein that the first component is "radially outward" or "outboard" of the second component. If, on the other hand, the first component resides closer to the axis than the second component, it may be stated herein that the first component is "radially inward" or "inboard" of the second component. The term "axial" refers to movement or position parallel to an axis. Finally, the term "circumferential" refers to movement or position around an axis. As provided below, such terms may be used relative to axial direction 30, radial direction 31, and circumferential direction 32 defined in relation to the center axis of a turbine engine or turbine.

Figure 1:
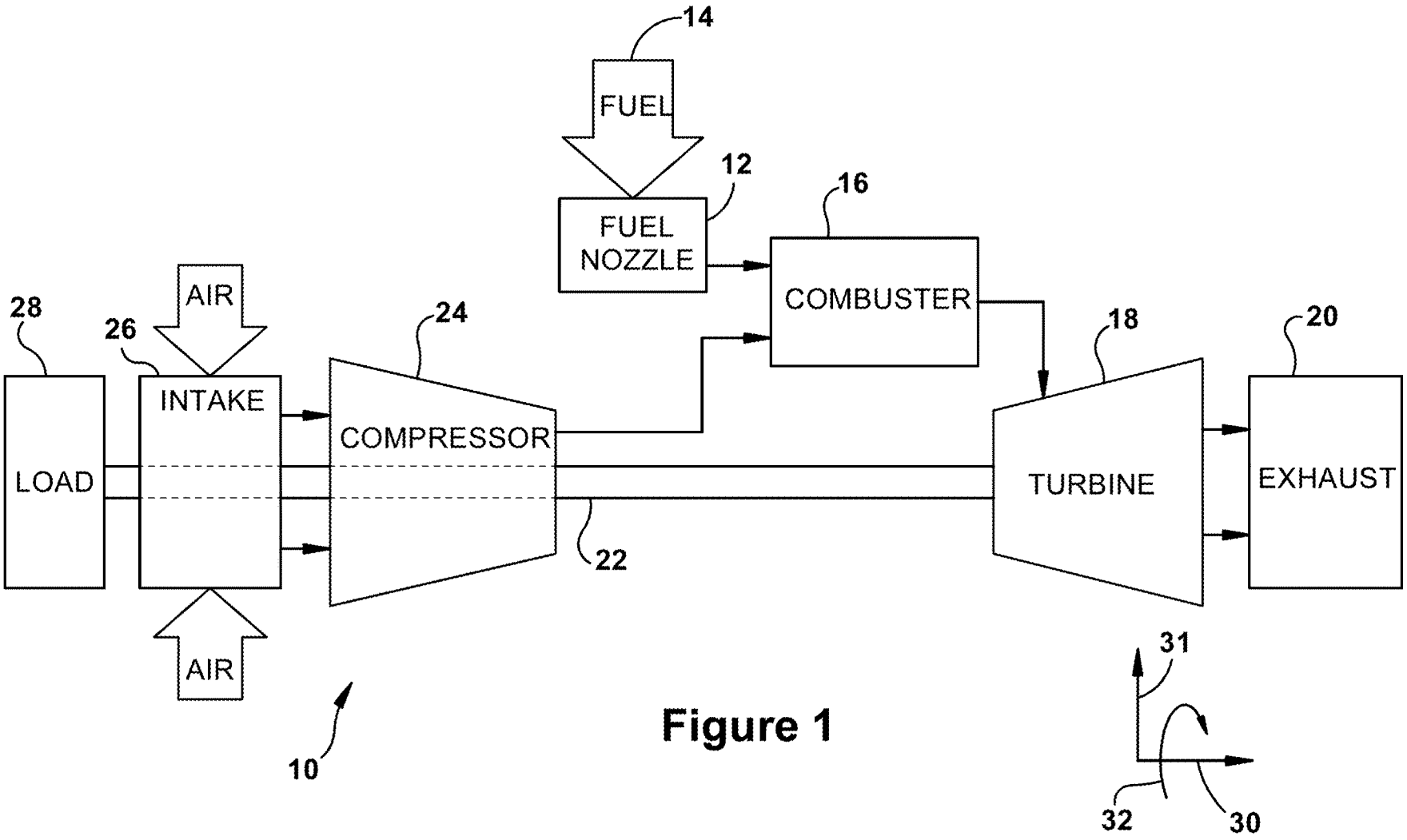
FIG. 1 is a block diagram of a gas turbine engine in which shrouds of the present disclosure may be used.

Turning to the drawings, FIG. 1 is a block diagram of a gas turbine system or engine (or "gas turbine") 10. As described more below, gas turbine 10 may include shroud segments having cooling channels that reduce stress modes in hot gas path components and improve the overall efficiency of the engine. Gas turbine 10 may use liquid or gas fuel, such as natural gas and/or a hydrogen rich synthetic gas. As depicted, fuel nozzles 12 intake a fuel supply 14, mix the fuel with an oxidant, such as air, oxygen, oxygen-enriched air, oxygen reduced air, or any combination thereof. Once the fuel and air have been mixed, the fuel nozzles 12 distribute the fuel-air mixture into a combustor 16 in a suitable ratio for optimal combustion, emissions, fuel consumption, and power output.

Gas turbine 10 may include one or more fuel nozzles 12 located inside one or more combustors 16. The fuel-air mixture combusts in a chamber within combustor 16, thereby creating hot pressurized exhaust gases. Combustor 16 directs the exhaust gases (e.g., hot pressurized gas) through a transition piece into alternating rows of stationary stator blades and rotating rotor blades, which causes rotation of a turbine section or turbine 18 within a turbine casing. The exhaust gases expand through turbine 18 and flow toward an exhaust outlet 20. As the exhaust gases pass through turbine 18, the gases force the rotor blades to rotate a shaft 22. Shaft 22 operably connects turbine 18 to a compressor 24. Shaft 22 defines a center axis of gas turbine 10, including the turbine 18 and compressor 24 thereof. Shaft 22 also is connected to a load 28, e.g., a vehicle or a stationary load, such as an electrical generator in a power plant. Relative to the center axis defined by shaft 22, an axial direction 30 is defined, which represents movement along the center axis, a radial direction 31 is defined, which represents movement toward or away from the center axis, and a circumferential direction 32 is defined, which represents movement around the center axis. Compressor 24 also includes blades coupled to shaft 22. As shaft 22 rotates, the blades within compressor 24 also rotate, thereby compressing air ingested via an air intake 26 as the air moves through compressor 24 and into fuel nozzles 12 and/or combustor 16.

A portion of the compressed air from compressor 24 may be diverted to turbine 18 without passing through combustor 16 to be utilized as a coolant for hot gas path components, such as shrouds and nozzles on the stator, along with rotor blades, disks, and spacers on the rotor. Turbine 18 may include one or more shroud segments (e.g., inner shroud segments) having an internal cooling configuration (or "cooling configuration") that includes cooling passages for circulating such coolant to control temperature during operation. As will be seen, cooling configurations of the present disclosure may be used within inner shroud segments more improving coolant efficiency as well as achieving other benefits related to structure and constructability. In this way, cooling configurations of the present disclosure may reduce stress modes, extend component service life, reduce component costs and maintenance costs, and improve engine efficiency.

Figure 2:
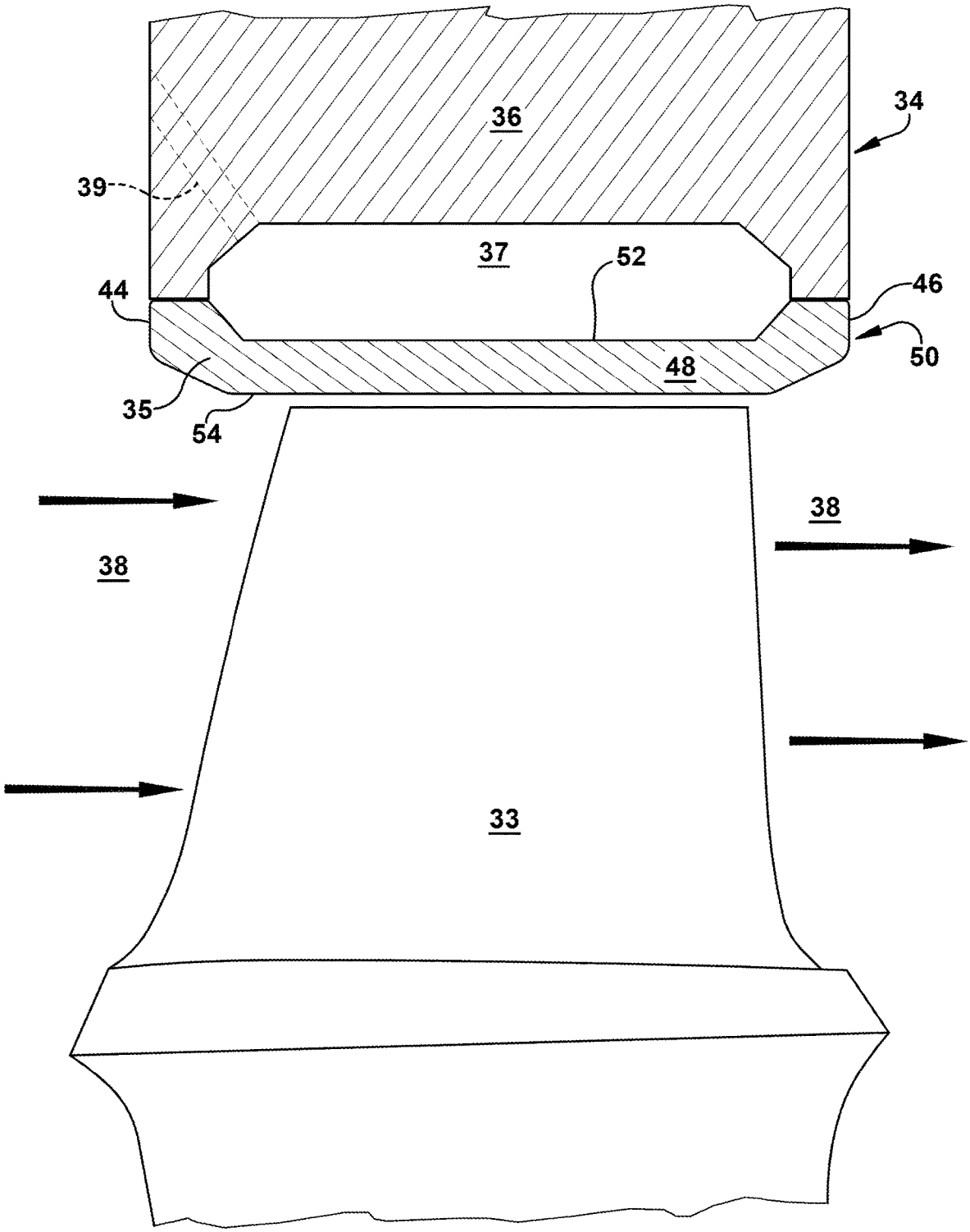
FIG. 2 is a side view of a hot gas path having a rotor blade and stationary shroud.

FIG. 2 shows an exemplary axial section of a hot gas path 38 as would be included within the turbine section of a gas turbine engine. As shown, hot gas path 38 may include a rotor blade 33 that is part of a row of rotor blades, which is disposed in serial flow relationship axially aft or downstream of a row of stationary turbine stator blades (not shown). Hot gas path 38 also may include a stationary shroud segment 34, which is circumferentially disposed about and radially outward or outboard of rotor blade 33. As illustrated, shroud segment 34 may include an inner shroud segment 35 that resides radially inward or inboard of an outer shroud segment 36. Multiple shroud segments 34 may be circumferentially stacked to form a shroud ring disposed just outboard of the row of rotor blades, with each of the shroud segments 34 having one or more inner shroud segments 35 coupled to one or more outer shroud segments 36. Between the assembly of inner and outer shroud segments 35, 36, a cavity 37 may be formed. For example, inner shroud segment 35 may be connected to outer shroud segment 36 via any conventional process, such as welding, brazing, interference or mechanical fit, so to form and seal cavity 37 for the functionality described herein. Inner shroud segment 35 and outer shroud segment 36 also may be formed as a single piece. During operation, a supply of pressurized cooling air or coolant may be delivered to cavity 37 via one or more coolant supply channels 39, which may be formed through outer shroud segment 36. As will be seen, coolant supplied to cavity 37 may then be directed into cooling passages or channels formed through the interior of inner shroud segment 35.

Figure 3:
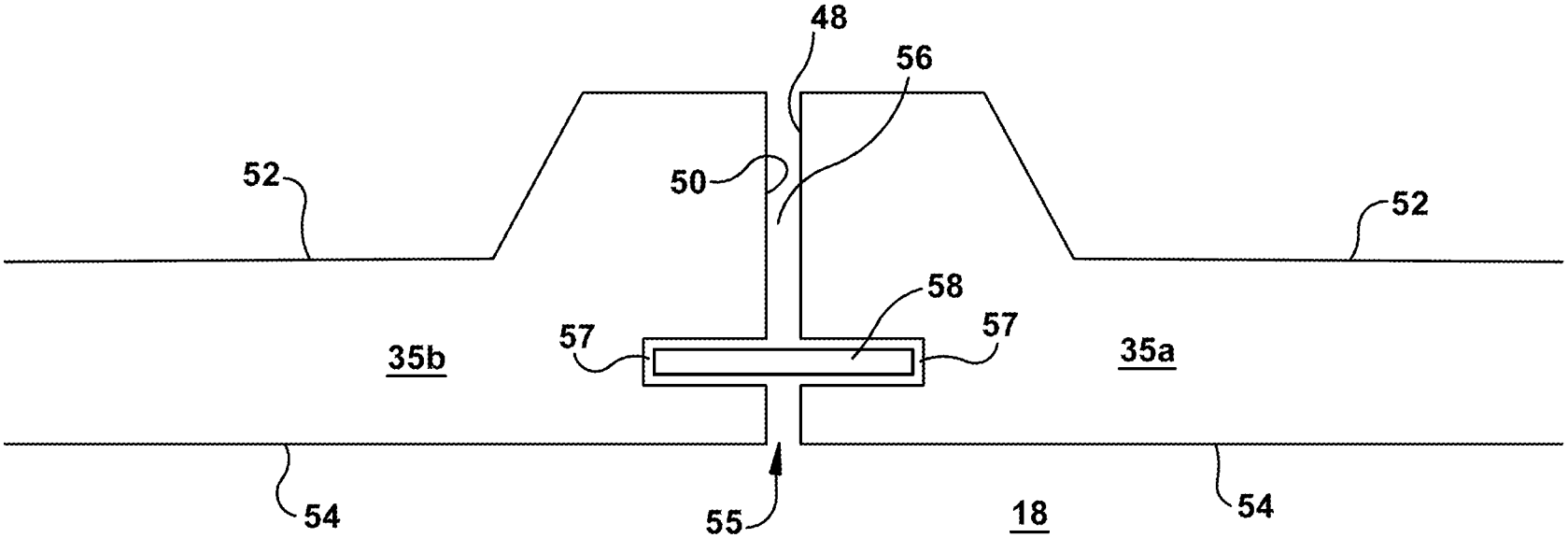
FIG. 3 is side cross-sectional view of abutting inner shroud segments in accordance with the present disclosure.

In regard to its general configuration and orientation within the turbine section, inner shroud segment 35 may be described as follows. As indicated in FIGS. 2 and 3, inner shroud segments 35 includes an upstream or leading edge 44 that opposes a downstream or trailing edge 46. Inner shroud segment 35 includes a first circumferential edge 48 that opposes a second circumferential edge 50, with the first and second circumferential edges 48, 50 extending between the leading edge 44 and the trailing edge 46. Further, inner shroud segment 35 is formed by a pair of opposed lateral sides or faces 52, 54 that extend between leading and trailing edges 44, 46 and first and second circumferential edges 48, 50. As used herein, opposed lateral faces 52, 54 include an outboard face 52 and inboard face 54. Outboard face 52 is directed toward outer shroud segment 36 and/or cavity 37, while inboard face 54 is directed toward the hot gas path 38 and defines a boundary thereof. As will be appreciated, inboard face 54 may be substantially planar between leading and trailing edges 44, 46, while having a gradual arcuate shape between first and second circumferential edges 48, 50.

Positioned as it is about the central axis of turbine 18, the shape and dimensions of inner shroud segment 35 may further be described relative to axial, radial and circumferential directions 30, 31, 32 of turbine 18. Thus, opposed leading and trailing edges 44, 46 are offset in the axial direction 30. As used herein, the distance of this offset in the axial direction 30 is defined as the width dimension (or "width") of inner shroud segment 35. Additionally, opposed first and second circumferential edges 48, 50 of inner shroud segment 35 are offset in the circumferential direction 32. As used herein, the distance of this offset in the circumferential direction 32 is defined as the length dimension (or "length") of inner shroud segment 35. Finally, the opposed inner and outboard faces 52, 54 of inner shroud segment 35 are offset in the radial direction 31. As used herein, the distance of this offset in the radial direction 31 is defined as the height dimension (or "height") of inner shroud segment 35.

With reference now to FIG. 3, a cross-sectional side view is provided of adjacent first and second inner shroud segments 35*a*, 35*b* in accordance with an exemplary hot gas path configuration. As indicated, adjacent inner shroud segments 35*a*, 35*b* abut one another along an interface 56 formed between first circumferential edge 48 of first inner shroud segment 35*a* and second circumferential edge 50 of second inner shroud segments 35*b*. As part of interface 56, a seal 55 is provided. Seal 55 includes slots 57 formed within each of the abutting circumferential edges 48, 50 for receiving a corresponding sealing member 58. In each case, slots 57 may extend along respective circumferential edges 48, 50 from leading edge 44 to trailing edge 46 of respective inner shroud segments 35*a*, 35*b*. A sealing member 58 is positioned within slots 57. Sealing member 58 may also extend from leading edge 44 to trailing edge 46 of inner shroud segments 35*a*, 35*b*. It will be appreciated that once inner shroud segments 35*a*, 35*b* are assembled to form interface 56, slots 57 cooperate or align to form a seal chamber that spans across interface 56. Sealing member 58 is correspondingly shaped to the seal chamber so that, once installed, it spans across interface 56 and thereby prevents or limits exhaust gases from leaking or escaping from hot gas path 18 therethrough.

Figure 4:
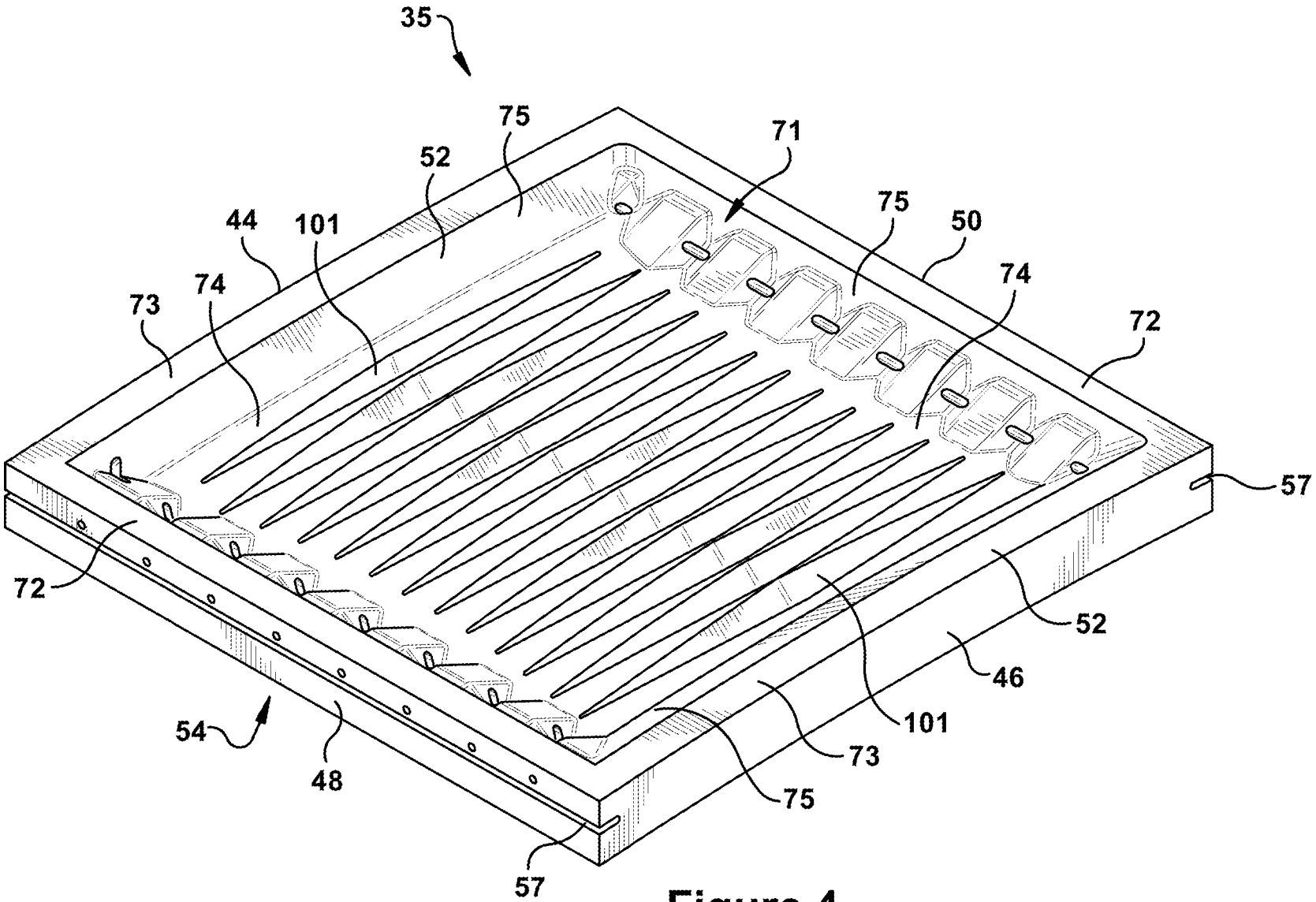
FIG. 4 is a perspective view of an inner shroud segment in accordance with the present disclosure.

With reference now to FIG. 4, an exemplary inner shroud segment 35 is shown that includes several aspects and features of the present disclosure. As inner shroud segment 35 of FIG. 4 includes the same general configuration and components as introduced above in relation to FIGS. 2 and 3, it has been labeled using like reference numerals. As will be described more below, present inner shroud segment 35 may additionally include several other novel internal and external configurations and features. For example, inner shroud segments 35 of the present disclosure may include cooling configurations having one or more of specifically configured cooling channels for receiving and directing coolant through interior regions. Further, inner shroud segments 35 of the present disclosure may include one or more specific exterior or surface configurations or features and/or interior or structural configurations or features, each of which provides benefits related to constructability, durable structure and/or material or weight reduction. As will be seen, aspects of the exterior and/or interior configurations may be enabled by or an enabler of aspects of the interior cooling configuration, where such combinations may enhance functionality, performance, and/or constructability of the component. Thus, alternative embodiments include combining any of the features or embodiments described herein with any of the other features or embodiments described herein. However, unless expressly limited, it should be assumed that the several features and embodiments presented herein also may be used separately without such combination.

As further indicated in FIG. 4, inner shroud segment 35 may include rails formed on outboard face 52 that surround and define an outboard cavity 71. In general, such rails 72, 73 represent areas of increased radial height or ridge formed adjacent to and extending along the edges of inner shroud segment 35. For descriptive purposes, the rails may be referred to as circumferential rails 72, which extend adjacent to circumferential edges 48, 50, and axial rails 73, which extend adjacent to leading and trailing edges 44, 46. The central area of inner shroud segment 35 surrounded by rails 72, 73 may be referred to as a floor 74 of outboard cavity 71. Further, the inward facing side of each of rails 72, 73 may be referred to as inward side 75. As will be appreciated, outboard cavity 71 forms a portion of cavity 37, as shown in FIG. 2.

Figure 5:
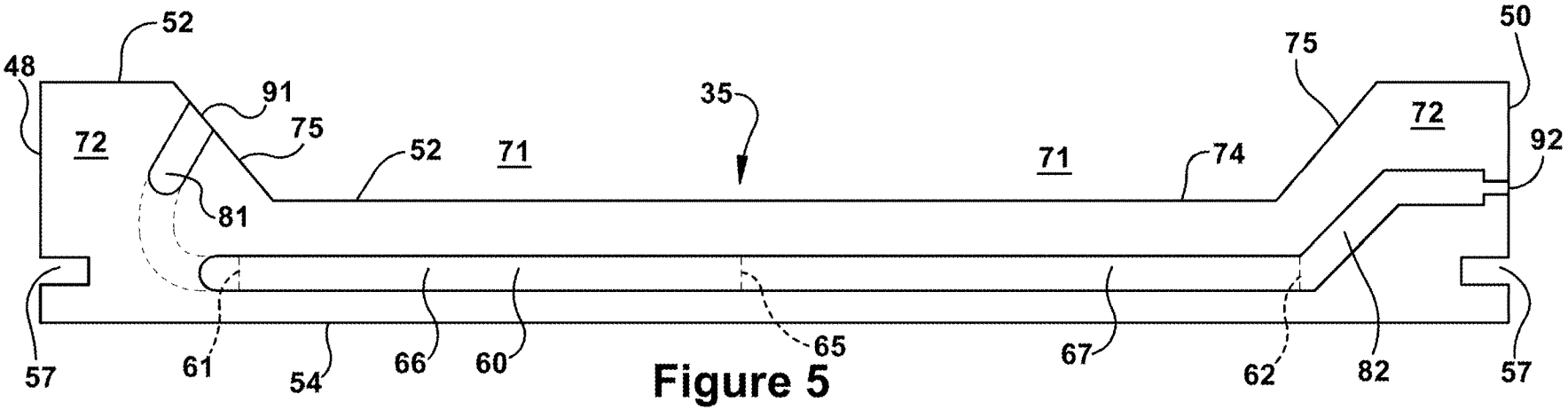
FIG. 5 is cross-section of an inner shroud segment showing an exemplary crossflow channel in accordance with the present disclosure.
Figure 6:
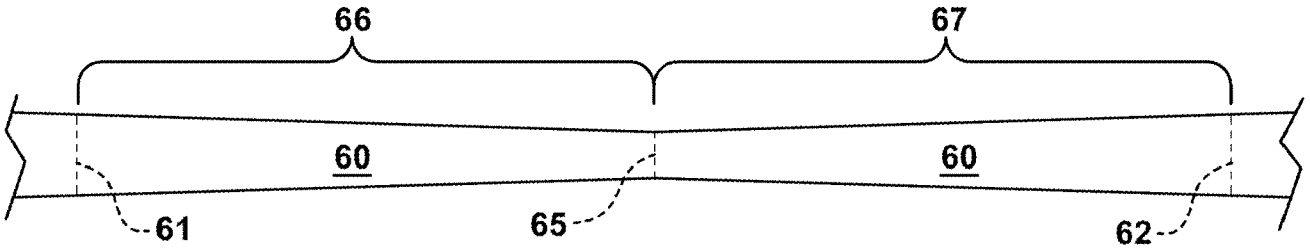
FIG. 6 provides a schematic top view of an exemplary crossflow channel in accordance with the present disclosure.
Figure 7:
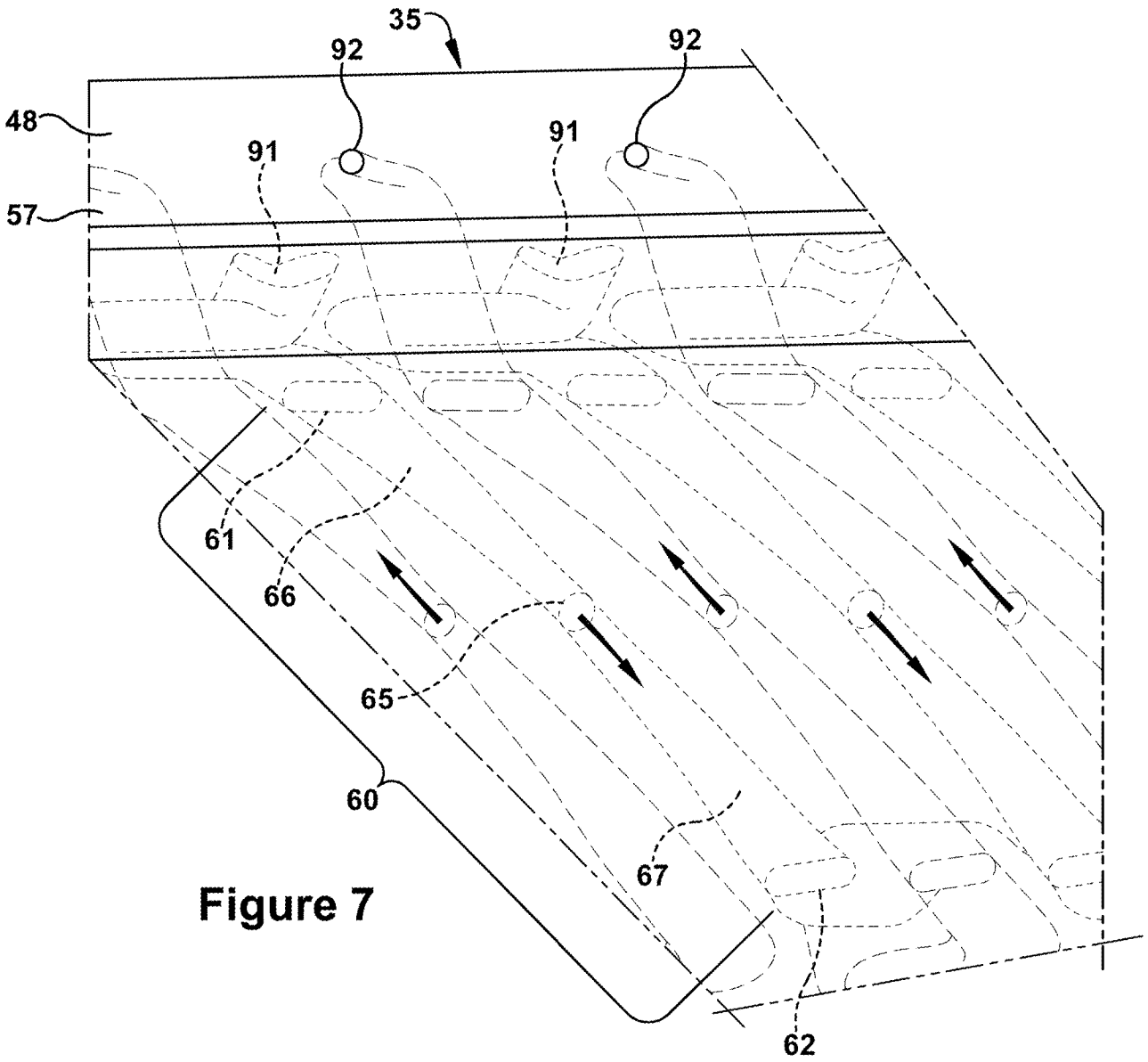
FIG. 7 is a transparent perspective view of an inner shroud segment having an exemplary arrangement of multiple crossflow channels in accordance with the present disclosure.

With reference now to FIGS. 5 through 7, an inner shroud segment 35 having one or more crossflow cooling channels (or "crossflow channels") 60 is introduced in accordance with exemplary embodiments of the present disclosure. For convenience, components and elements that correspond to those already identified in the preceding figures are identified with similar reference numerals, but only particularly discussed as necessary for an understanding of the present embodiments. It should be appreciated that, while much of the following discussion describes characteristics of crossflow channels 60 with reference to a single, exemplary crossflow channel 60, cooling configurations of the present disclosure may include any number of such crossflow channels 60, e.g., 1, 5, 10, 20, etc. FIG. 5 provides a simplified cross-sectional view showing the basic orientation and position of an exemplary crossflow channel 60. FIG. 6 provides a schematic top view of an exemplary crossflow channel 60, which will be used to discuss particular characteristics. Finally, FIG. 7 provides a transparent, perspective view of an inner shroud segment 54 in which an exemplary arrangement having multiple crossflow channels 60 is shown.

As shown in FIGS. 5 and 6, crossflow channels 60 of the present disclosure may extend lengthwise between a first or upstream end 61 and a second or downstream end 62. Between upstream end 61 and downstream end 62, crossflow channel 60 may be described in accordance with a junction point 65 that, for the purposes of description, divides crossflow channel 60 lengthwise into connected sections, in which a first or upstream section 66 connects to a second or downstream section 67. Upstream section 66 extends between upstream end 61 and junction point 65, while downstream section 67 extends between junction point 65 and downstream end 62.

As shown in FIGS. 6 and 7, crossflow channels 60 of the present disclosure may be configured having a variable cross-sectional flow area, i.e., one that varies lengthwise between upstream and downstream ends 61, 62. According to exemplary embodiments, the cross-sectional flow area varies such that: the cross-sectional flow area of upstream section 66 decreases between upstream end 61 and junction point 65 (i.e., as upstream section 66 extends from upstream end 61 to junction point 65); and the cross-sectional flow area of downstream section 67 increases between junction point 65 and downstream end 62 (i.e., as downstream section 67 extends from junction point 65 to downstream end 62). Thus, crossflow channels 60 may have a cross-sectional flow area that is similar to that of an hour-glass. That is, the cross-sectional flow area of crossflow channel 60 may narrow to junction point 65, which represents the "neck" of an hour-glass, and then widens from there. As used herein, junction point 65 or neck is the location at which crossflow channel 60 comprises a minimum cross-sectional flow area.

The decreasing of the cross-sectional flow area through upstream section 66 may be a smooth gradual decrease. The increasing of the cross-sectional flow area through downstream section 67 may be a smooth gradual increase. The manner by which the cross-sectional flow area of crossflow channel 60 decreases or increases may include a narrowing or widening, respectively, of the crossflow channel 60 in one or more dimensional directions 30, 31, 32. According to exemplary embodiments, as shown most clearly in FIG. 6, the decreasing of the cross-sectional flow area of upstream section 66 is accomplished by a smooth and gradual narrowing in the axial direction 30, while the increasing of the cross-sectional flow area of downstream section 67 is accomplished by a smooth gradual widening in the axial direction 30. Though other configurations are possible, according to exemplary embodiments, the decreasing of the cross-sectional flow area of upstream section 66 results in the cross-sectional flow area at junction point 65 being less than 50% of the cross-sectional flow area at upstream end 61. The increasing of the cross-sectional flow area of downstream section 67 similarly may result in the cross-sectional flow area at junction point 65 being less than 50% of the cross-sectional flow area at downstream end 62. According to other exemplary embodiments, the decreasing of the cross-sectional flow area of upstream section 66 results in the cross-sectional flow area at junction point 65 being less than 65% of the cross-sectional flow area at upstream end 61, and the increasing of the cross-sectional flow area of downstream section 67 results in the cross-sectional flow area at junction point 65 being less than 65% of the cross-sectional flow area at downstream end 62.

Though other configurations are possible, crossflow channel 60 of the present disclosure may extend lengthwise along a substantially linear path that is oriented in the circumferential direction 32. That is, the longitudinal axis of crossflow channel 60 approximately aligns with or is parallel to the circumferential direction 32 of the turbine. Thus, according to exemplary embodiments, crossflow channel 60 is oriented within inner shroud segment 35 to extend approximately in the circumferential direction 32, for example, forming an angle between crossflow channel 60 and the circumferential direction 32 that is less than 15°. According to other embodiments, crossflow channel 60 is oriented such that an angle formed between crossflow channel 60 and the circumferential direction 32 is less than 5°. According to exemplary embodiments, crossflow channels 60 within the shroud cooling configuration may have a parallel arrangement, i.e., be arranged parallel with respect to each other. Further, as shown in FIG. 7, such crossflow channels 60 may be configured according to an alternating counterflow arrangement in which adjacent ones of crossflow channels 60 have oppositely oriented flow directions, i.e., oriented so that coolant flows in the opposite directions.

Crossflow channel 60 may extend across a majority of the length of inner shroud segment 35. For example, according to exemplary embodiments, crossflow channel 60 extends across at least 60% of the length of inner shroud segment 35. According to other embodiments, crossflow channel 60 extends across at least 75% of the length of inner shroud segment 35. Oriented in this manner shown, the length of crossflow channel 60 is defined as the distance in the circumferential direction 32 between upstream end 61 and downstream end 62. The height of crossflow channel 60 is defined as the distance in the radial direction 31 between an inner radial floor and an outer radial ceiling of crossflow channel 60. As shown in FIG. 5, according to exemplary embodiments, the height of crossflow channel 60 may be substantially constant between upstream and downstream ends 61, 62. As previously stated, crossflow channel 60 may be disposed near and inner radial face 54. According to preferred embodiments, as shown in FIG. 5, crossflow channel 60 may maintain a substantially constant distance or offset from inboard face 54. As shown in FIG. 6, the width of crossflow channel 60 is defined herein as a distance in the axial direction 30 between a first side and a second side of crossflow channel 60. According to exemplary embodiments, the decreasing of the cross-sectional flow area of upstream section 66 is achieved via a gradual tapering of the width of crossflow channel 60. Similarly, the increasing of the cross-sectional flow area of downstream section 67 is achieved via a gradual enlarging or widening of the width of crossflow channel 60.

According to exemplary embodiments, upstream end 61 of crossflow channel 60 is disposed near first circumferential edge 48. For example, upstream end 61 of crossflow channel 60 is disposed no further from first circumferential edge 48 than a distance equal to 20% of the length of inner shroud segment 35. Similarly, downstream end 62 of crossflow channel 60 may be disposed near second circumferential edge 50. For example, downstream end 62 of crossflow channel 60 may be disposed no further from second circumferential edge 50 than a distance equal to 20% of the length of inner shroud segment 35.

According to exemplary embodiments, junction point 65 is located near the middle portion of crossflow channel 60. For example, according to exemplary embodiments, junction point 65 is located within a range of 35% to 65% of the length of crossflow channel 60. According to other embodiments, junction point 65 is located within a range of 45% to 55% of the length of crossflow channel 60. Junction point 65 also may be located at the midpoint of the length of crossflow channel 60.

According to exemplary embodiments, as indicated most clearly in FIG. 5, crossflow channel 60 may be supplied coolant via a feed channel 81. Crossflow channel 60 also may connect to an outlet channel 82 for expelling the coolant passing through it. As will be discussed more below, feed channel 81 may extend between an inlet 91 formed on an exterior surface of inner shroud segment 35 and upstream end 61 of crossflow channel 60, while outlet channel 82 may extend between downstream end 62 of crossflow channel 60 and an outlet 92 formed on an exterior surface of inner shroud segment 35. For example, inlet 91 may be formed within outboard cavity 71 of inner shroud segment 35 and be in fluid communication with cavity 37. More specifically, inlet 91 may be formed on inward side 75 of circumferential rails 72. Outlet 92 may be formed on the first or second circumferential edges 48, 50. Given this arrangement, it should be appreciated that coolant supplied to cavity 37 may be ingested by crossflow channel 60 via inlet 91. The coolant then may be directed via feed channel 81 to crossflow channel 60 for circulation therethrough in order to cool inboard face 54 of inner shroud segment 35. Once the coolant has passed through crossflow channel 60, it may be directed by outlet channel 82 to outlet 92 where it is expelled from inner shroud segment 35.

As further depicted, feed channel 81 may be disposed within one of the circumferential rails 72 while the corresponding outlet channel 82 is disposed within the opposing circumferential rail 72. As will be discussed more below, feed channel 81 may slant in an inboard direction from inlet 91 toward a connection with upstream end 61 of crossflow channel 60. That connection may be near inboard face 54. Feed channel 81 may include a curving path that turns the flow direction of the coolant approximately 180° relative to the circumferential direction 32. Outlet channel 82 may slant in an outboard direction from the connection it makes with downstream end 62 of crossflow channel 60 toward outlet 92.

FIG. 7 provides an exemplary embodiment of an inner shroud segment 35 having multiple crossflow channels 60. As depicted, such crossflow channels 60 may be oppositely oriented according to an alternating arrangement, which will be referred to herein as an alternating counterflow arrangement. Thus, a first set of crossflow channels 60 may be oriented to direct coolant to outlets 92 formed on first circumferential edge 48, while a second set of crossflow channels 60, which alternate in placement with ones of the first set, direct coolant to outlets 92 formed on second circumferential edge 50. Given this arrangement, the first set of crossflow channels 60, thus, has inlets 91 formed on inward side 75 of circumferential rail 72 of second circumferential edge 50, while the second set of crossflow channels 60 has inlets 91 formed on inward side 75 of circumferential rail 72 of first circumferential edge 48. In this way, the present cooling configuration provides coolant evenly to the various interior regions of inner shroud segment 35 and, once substantially exhausted, the coolant can be released within interface 56 in order to provide cooling and sealing benefits therein. The alternating parallel arrangement of crossflow channels 60 allows outlets 92 to be spaced evenly and at regular intervals across circumferential edges 48, 50.

The disclosed crossflow channels have been found to cool hot gas components, such as stationary shrouds, using less coolant than conventional cooling configurations, resulting in reduced costs associated with cooling and greater engine efficiency. For example, the crossflow channels of the present disclosure maximize the use of the coolant's heat capacity in a way that maintains a more uniform temperature within the inner shroud segment and, particularly, the region near the inboard face. Because the mass flow rate of the coolant through the crossflow channel remains substantially constant, the decreasing cross-sectional flow area through the upstream section results in an increase in coolant velocity. That is, as the coolant moves from the upstream end to the junction point or neck, the decreasing cross-sectional flow area increases coolant velocity. Since duct flow heat transfer coefficients (HTC) are directly dependent on fluid velocity, the increase in coolant velocity increases HTC as the coolant travels through the upstream section of the crossflow channel. Of course, as any coolant moves through a heated duct, it absorbs heat from the surrounding walls and increases in temperature, making the coolant less effective. According to the present application, however, this increase in temperature/decrease in coolant effectiveness is offset by the increasing heat transfer coefficients resulting from the increasing coolant velocity. In this way, the coolant maintains a relatively constant heat transfer rate as it moves through the upstream section of the crossflow channel. The junction point or neck may be positioned along the length of the crossflow channel. For example, the junction point may be position so that once the coolant moving through the crossflow channel has absorbed substantially all the heat it is capable of absorbing, the cross-sectional flow area widens so that the spent coolant is efficiently directed toward an outlet. According to preferred embodiments, to promote cooling that is uniform through the inner shroud segment, the cooling configuration may have an alternating counterflow arrangement, i.e., neighboring crossflow channels have opposite coolant flow directions. This arrangement results in greater cooling uniformity, as each downstream section of the crossflow channels is compensated by adjacent and flanking upstream sections of the neighboring crossflow channels.

Figure 8:
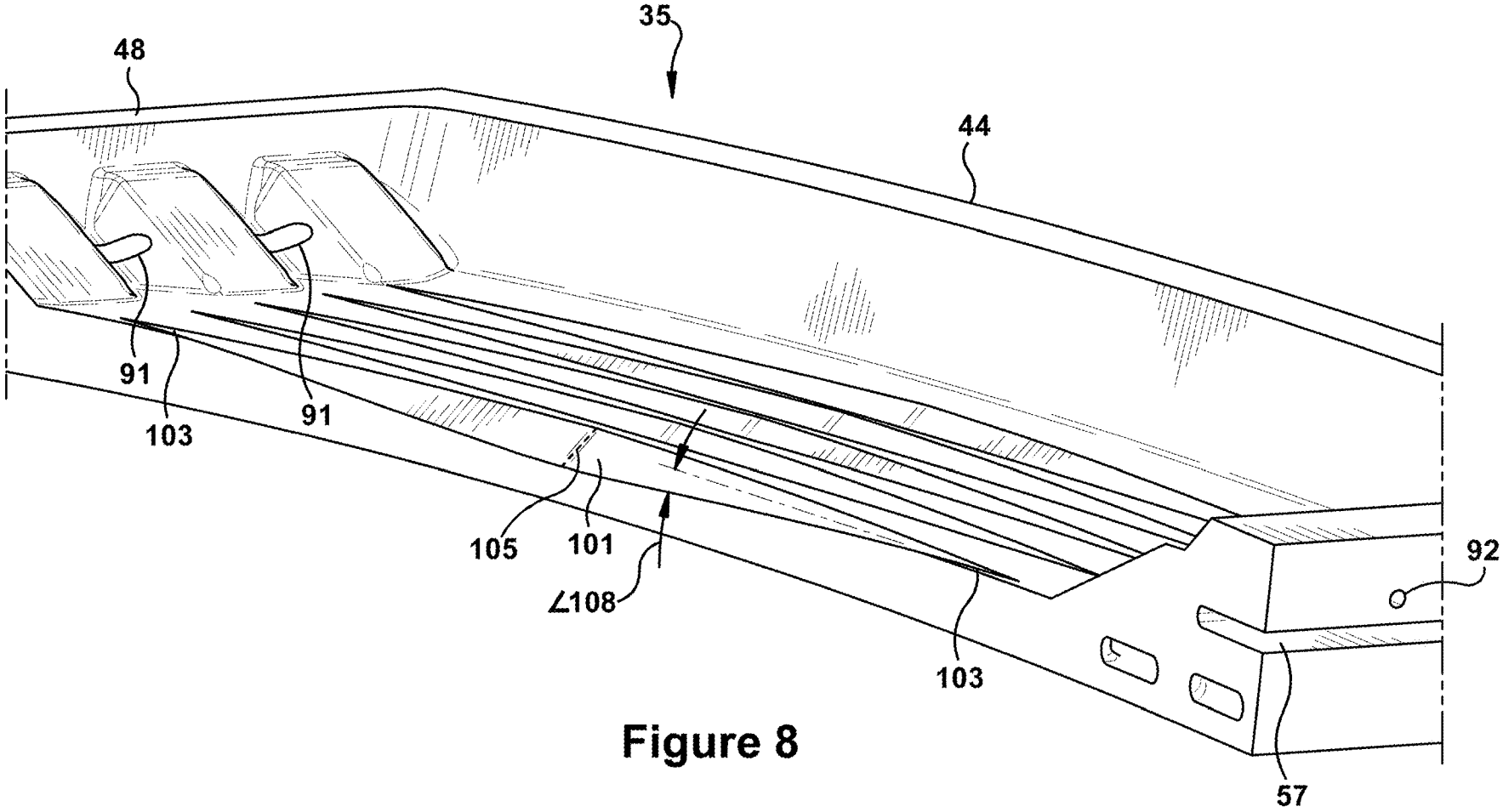
FIG. 8 is a perspective view of an inner shroud segment in which exemplary troughs are formed in the floor of an outboard cavity according to embodiments of the present disclosure.
Figure 9:
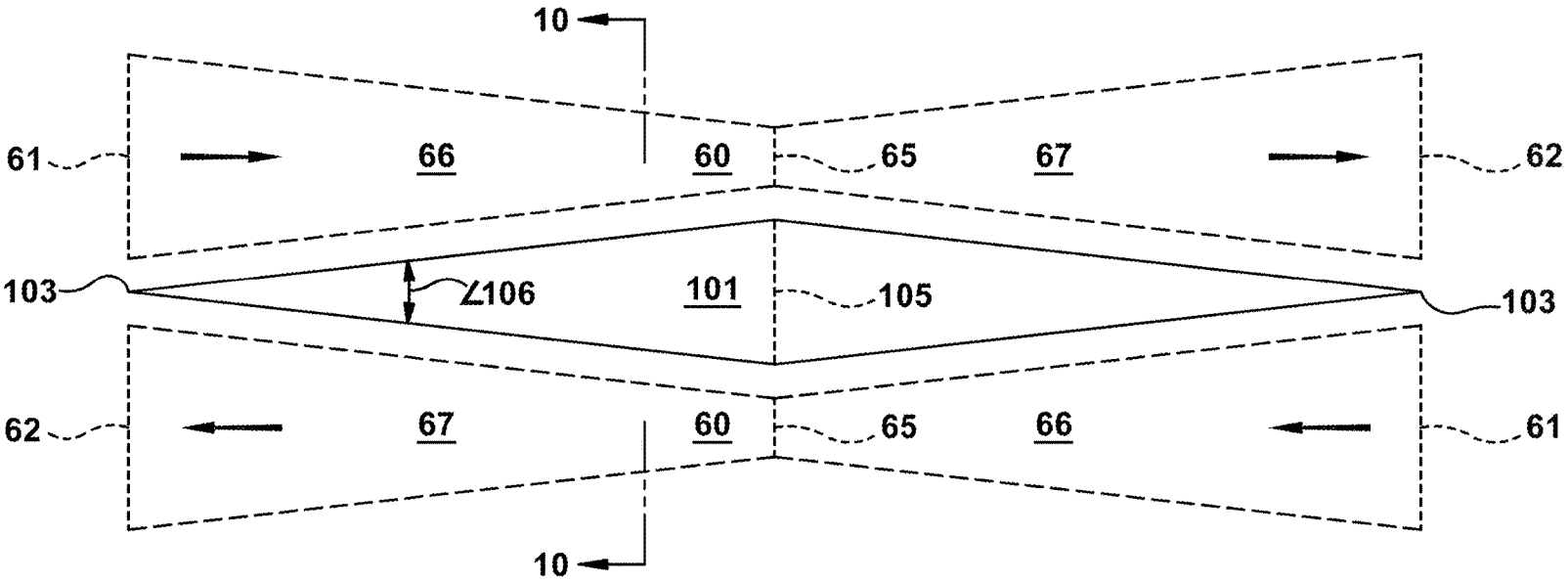
FIG. 9 provides a top view of an exemplary trough formed between crossflow channels in accordance with embodiments of the present disclosure.
Figure 10:
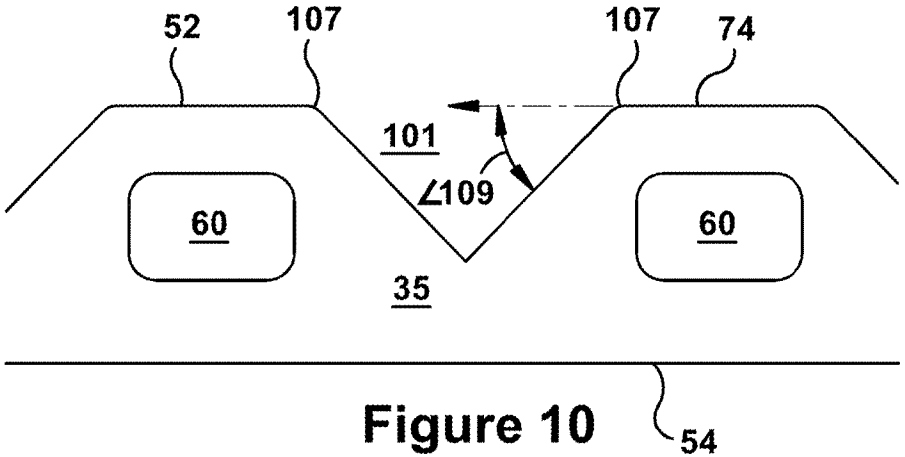
FIG. 10 provides a section view along the sight line 10-10 of FIG. 9.

With reference now to FIGS. 8 through 10, according to alternative embodiments, inner shroud segment 35 may include elongated furrows or troughs 101, which are formed within outboard face 52 or, more specifically, within floor 74 of outboard cavity 71 of inner shroud segment 35. Each trough 101 may extend lengthwise between ends 103 positioned near the opposing circumferential rails 72 of inner shroud segment 35. Along this length, each trough 101 may have a variable depth and width. As used herein, the depth of trough 101 is defined as the distance in the radial direction 31 between the surrounding surface of floor 74 and the lowest point within trough 101. The width of trough 101 is defined as the distance in the axial direction 30 between opposing sides 107 of trough 101. The variable depth and width may include trough 101 being shallower and narrower, respectively, at ends 103 and then deeper and wider, respectively, as trough 101 extends toward a central area or midline, which is defined via dividing line 105. Thus, trough 101 may widen and deepen as it extends inwardly from ends 103 toward dividing line 105. As illustrated, dividing line 105 may be a reference location designating the point along the length of trough 101 having the greatest width and depth.

The widening of trough 101 from each of ends 103 may be smooth and gradual. As indicated in FIG. 9, the widening of trough 101 from each of end 103 may be linear and, thus, describable in accordance with an angle 106 formed between sides 107. Though other configurations are possible, angle 106 may be between 5° and 15°. According to preferred embodiments, as shown in FIG. 9, the widening of trough 101 may correspond to the narrowing of the pair of crossflow channels 60 that are formed to each side of the trough 101. The narrowing of adjacent crossflow channels 60 toward their respective necks or junction points 65, as described above, may make available the room for trough 101 to widen and deepen, while also maintaining a close side-by-side relationship between trough 101 and neighboring crossflow channels 60. The widening and deepening of each of the troughs 101 may be configured such that a substantially constant distance is maintained between the sides of the trough 101 and the sides of the pair of crossflow channels 60 that flank the trough 101. Further, dividing line 105 of trough 101 may align circumferentially with junction points 65 of the adjacent crossflow channels 60. According to exemplary embodiments, dividing line 105 is located within a range of 35% to 65% of the length of trough 101.

According to other embodiments, dividing line 105 is located within a range of 45% to 55% of the length of trough 101.

The deepening of trough 101 from each of ends 103 may be smooth and gradual. As shown in FIG. 8, trough 101 may deepen from each of end 103 according to a relatively shallow first angle 108. For example, though other configurations are also possible, first angle 108 may be between 5° and 15°. As shown in FIG. 10, trough 101 may deepen from each side 107 according to a second angle 109, which is generally steeper than first angle 108. Though other configurations are also possible, second angle 109 (or "angle of descent") may be between 25° and 45°.

Though other configurations are possible, trough 101 of the present disclosure may be substantially linear and oriented in the circumferential direction 32. That is, the longitudinal axis of trough 101 may approximately align with or be parallel to the circumferential direction 32 of the turbine. Thus, according to exemplary embodiments, trough 101 may be oriented within inner shroud segment 35 to extend approximately in the circumferential direction 32, and, for example, may be arranged parallel to any of the embodiments of crossflow channels 60 discussed above. Each of troughs 101 may be positioned between and extend lengthwise in parallel to the pair of the crossflow channels 60 that flank it. Trough 101 may extend in this way across a majority of the length of inner shroud segment 35. For example, according to exemplary embodiments, trough 101 extends across more than 50% of the length of inner shroud segment 35. According to other embodiments, trough 101 extends across at least 65% of the length of inner shroud segment 35. Multiple, parallel troughs 101 may be provided, as illustrated.

The inclusion of the troughs embodiments described herein may provide several advantages to inner shroud segments. First, the troughs provide a way to remove material from inner shroud segments, making the components more economical to produce as well as advantageously reducing overall weight of the engine. Second, configured as they are, the troughs may together form a corrugated truss-like structure between the leading and trailing edges of the inner shroud segment that remains rigid so that the removal of material does not negatively impact structural robustness. Third, the troughs increase the surface area of the outboard face of the inner shroud segment. As the outboard face is exposed to cooler temperatures, this benefits the temperature profile through the component during operation. Fourth, the manner in which the troughs correspond to the variable shape of the crossflow channels results in increased surface area of the outboard face residing near the crossflow channels, which is reduces coolant temperature therein and enhances its effectiveness.

With reference now to FIGS. 11 through 15, further embodiments of interior cooling configurations of the present disclosure will be presented. For convenience, components and elements that correspond to those already identified in the preceding figures—particularly those related to crossflow channel 60 of FIGS. 5 through 7—are identified with similar reference numerals, but only particularly discussed as necessary for an understanding of present embodiments. As will be seen, embodiments of FIGS. 11 through 15 include additional characteristics and embodiments related primarily to feed channel 81 and outlet channel 82. These characteristics will be discussed in relation to both: 1) a single cooling channel having feed channel 81 as an upstream section, a middle section (e.g., crossflow channel 60), and outlet channel 82 as a downstream section; and 2) a feed and outlet channel configuration 121 that includes adjacent feed and outlet channels 81, 82 that attach to adjacent counterflowing cooling channels, such as a pair of adjacent crossflow channels 60. In regard to the latter, the discussion of feed and outlet channel configuration 121 focuses on the manner in which neighboring feed and outlet channels 81, 82 are configured in relation to each other for improved cooling performance, spatial efficiency, and structural robustness.

Figure 12:
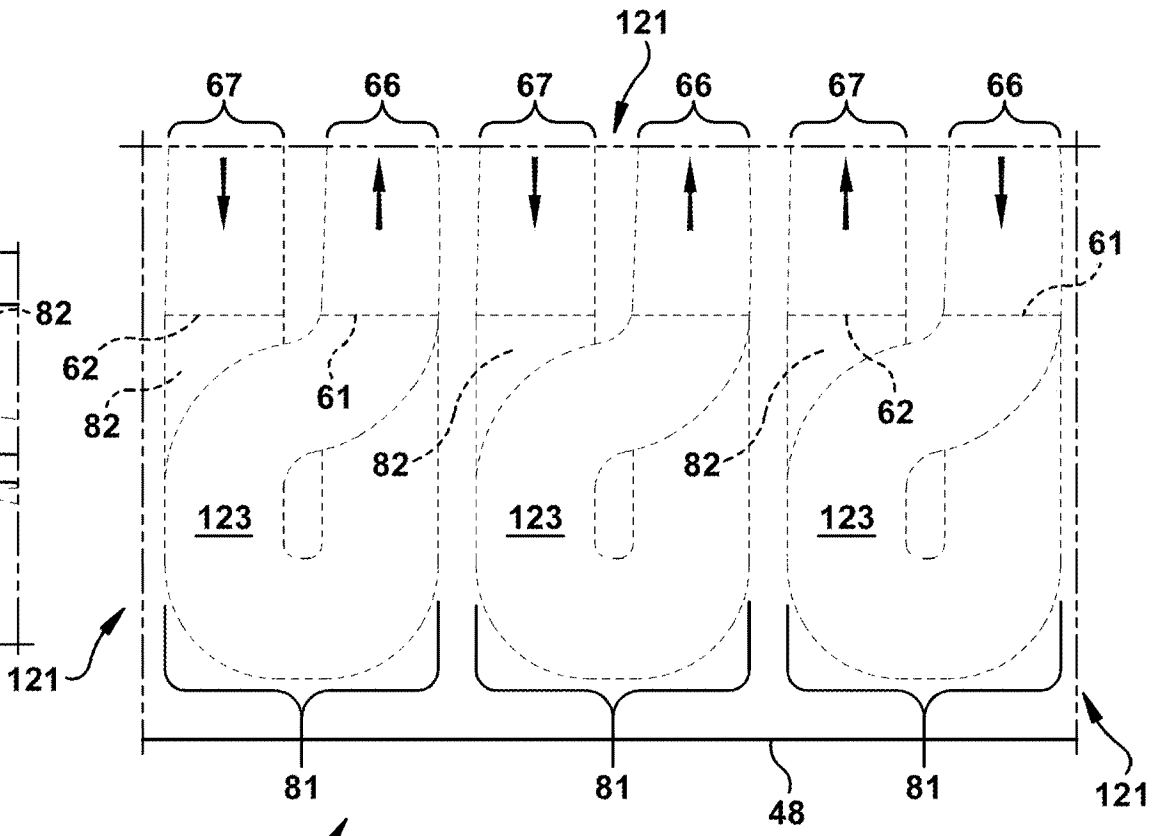
FIG. 12 shows a transparent inner radial view of an exemplary feed and outlet channel configuration in accordance with the present disclosure.
Figure 11:
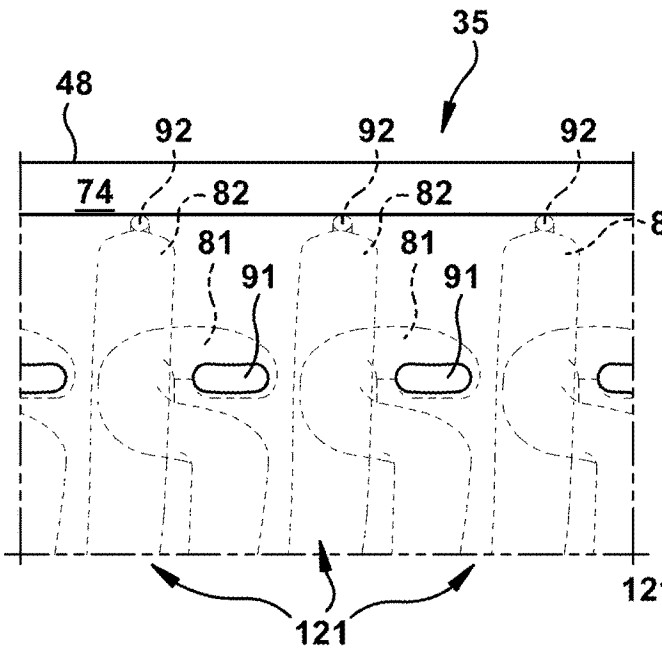
FIG. 11 shows a transparent outer radial view of an exemplary feed and outlet channel configuration in accordance with the present disclosure.
Figure 13:
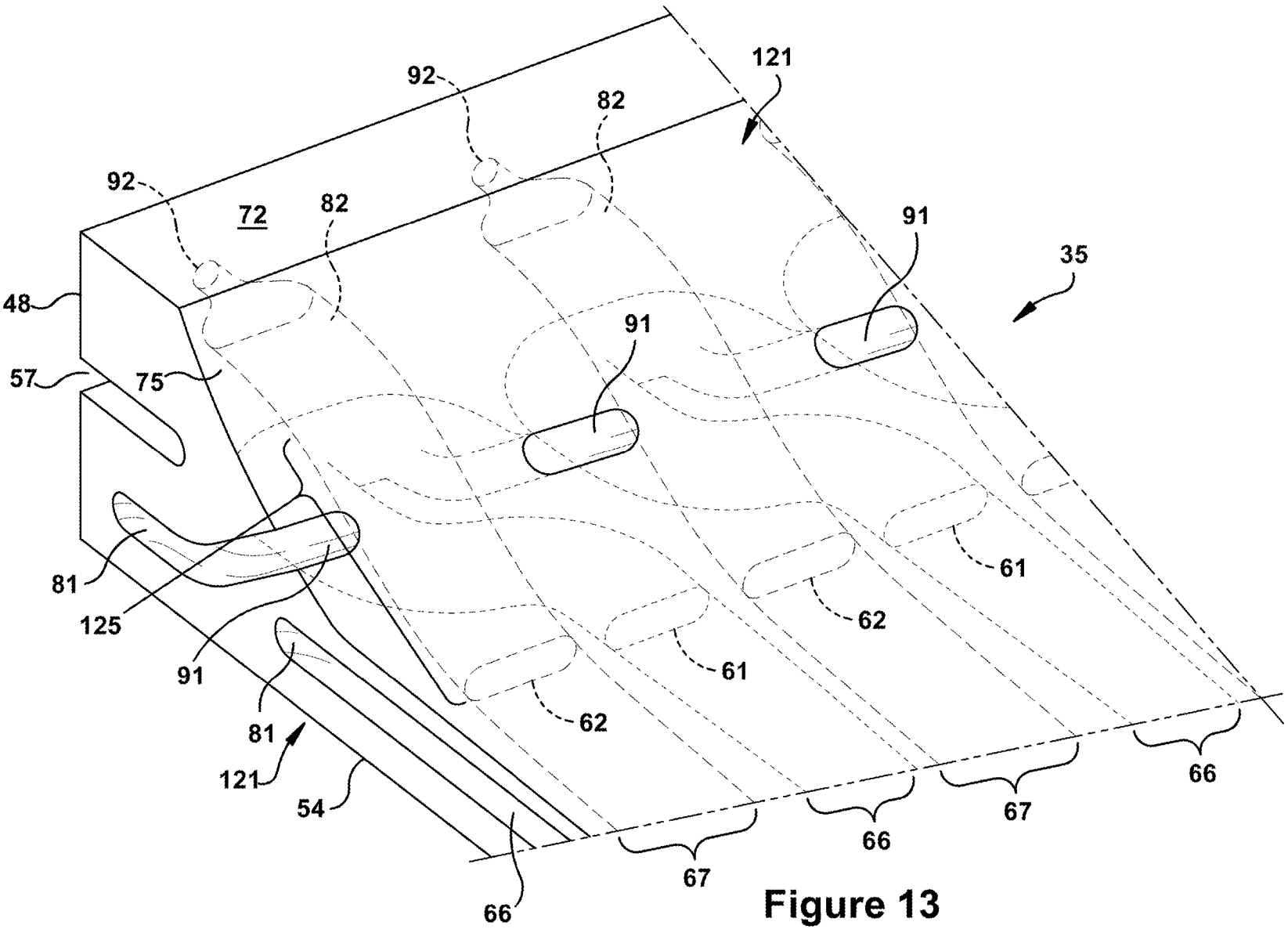
FIG. 13 shows a perspective transparent view with cross-section taken along a feed channel in accordance with an exemplary feed and outlet channel configuration of the present disclosure.
Figure 14:
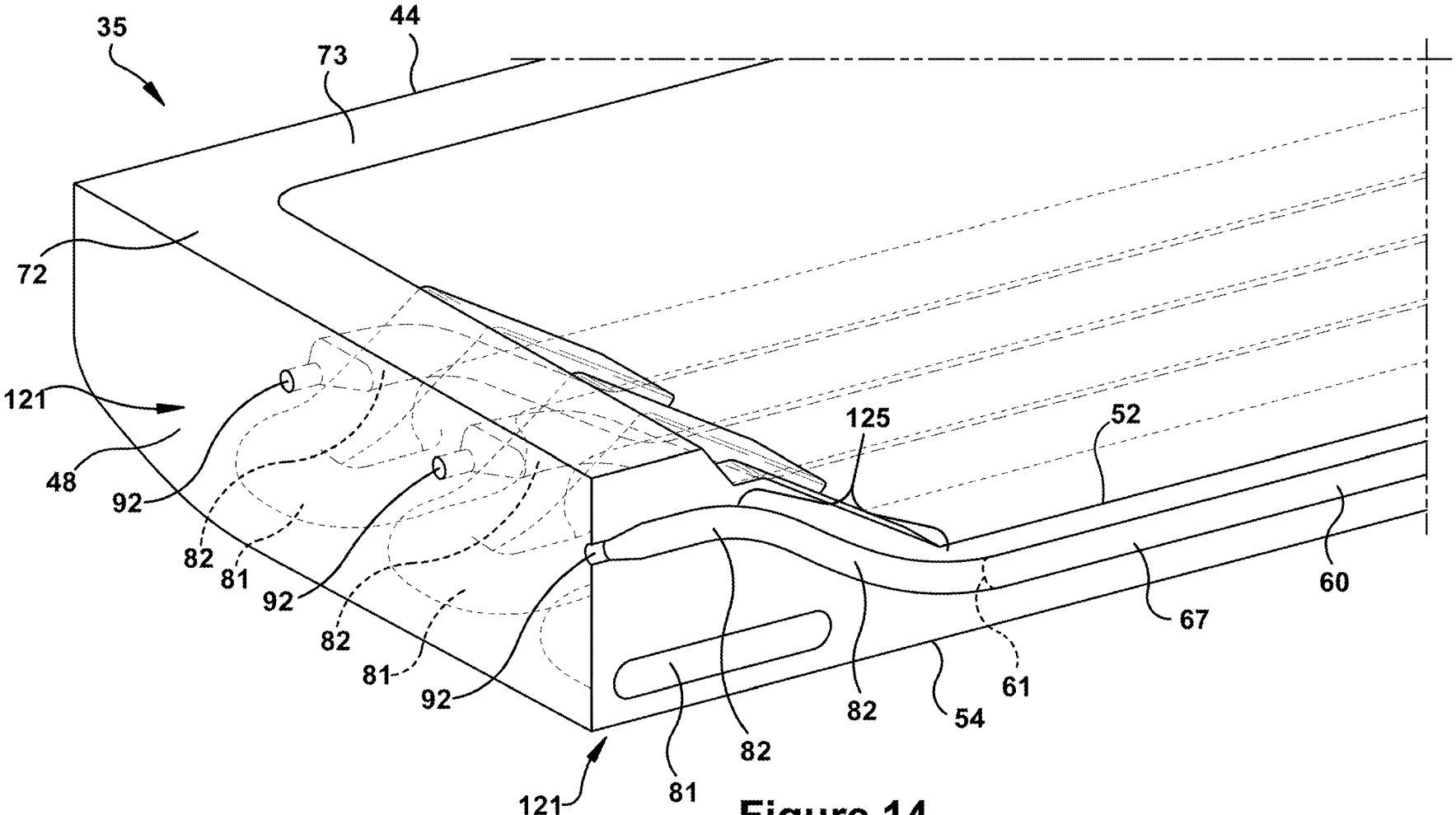
FIG. 14 shows a perspective transparent view with cross-section taken along an outlet channel in accordance with an exemplary feed and outlet channel configuration of the present disclosure.
Figure 15:
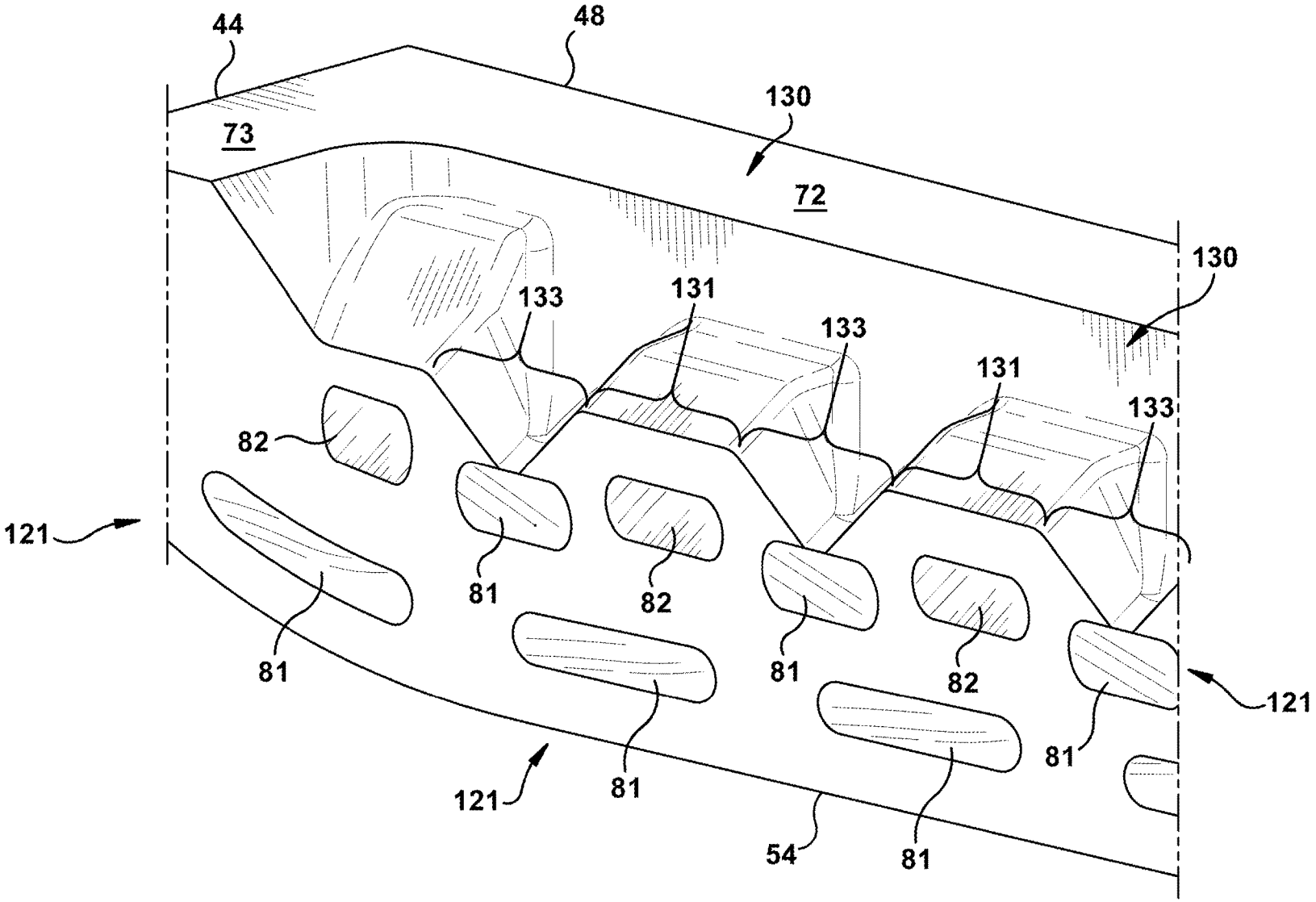
FIG. 15 shows a perspective view with cross-section taken across outlet and inlets channels in accordance with an exemplary feed and outlet channel configuration of the present disclosure.

For example, feed and outlet channel configurations 121 may be disposed near an edge of inner shroud segment 35—as depicted, first or second circumferential edges 48, 50—and function to supply/remove coolant to/from a pair of adjacent counterflowing crossflow channels 60 (also "paired counterflowing crossflow channels 60"). As will be seen, embodiments of feed and outlet channel configuration 121 provide an efficient way by which paired counterflowing crossflow channels 60 may have coolant delivered thereto and removed therefrom, while also providing enhanced cooling performance. FIGS. 11 and 12 present transparent outer and inner radial views, respectively, of feed and outlet channel configuration 121 in accordance with the present disclosure. FIG. 13 shows a transparent perspective view with cross-section taken along one of the feed channels 81 within an exemplary feed and outlet channel configuration 121, while FIG. 14 shows a transparent perspective view with cross-section taken along one of the outlet channels 82 within an exemplary feed and outlet channel configuration 121. Finally, FIG. 15 shows a perspective view with cross-section taken transverse to both feed channel 81 and outlet channel 82 in accordance with the present disclosure.

According to an exemplary embodiment, each crossflow channel 60 may connect to a feed channel 81 at an upstream end 61 and an outlet channel 82 at a downstream end 62, wherein feed channel 81 and outlet channel 82 may include any of the characteristics of the embodiments disclosed herein. According to exemplary operation, cooling channels configured in this manner may generally function as follows. The cooling channel may ingest coolant via inlet 91, and then deliver that coolant to crossflow channel 60 via feed channel 81. Coolant then may pass through crossflow channel 60 and, thereby, cool inboard face 54 of inner shroud segment 35. Once it has passed through crossflow channel 60, then coolant may be directed via outlet channel 82 to outlet 92, whereupon it is expelled from inner shroud segment 35.

In regard to embodiments of feed and outlet channel configurations 121, specific characteristics will now be presented with reference to the illustrated configurations. For example, feed and outlet channel configuration 121 may connect to a pair of adjacent counterflowing crossflow channels 60, which, as already described, may extend side-by-side across inner shroud segment 35. According to preferred embodiments, feed and outlet channel configuration 121 is disposed at each opposing end of such a pair of adjacent counterflowing crossflow channels 60. More generally, feed and outlet channel configuration 121 may be repeated as necessary within inner shroud segment 35 so that it is used with each such pair of counterflowing adjacent crossflow channels 60. For purposes of describing an exemplary feed and outlet channel configuration 121, the pair of corresponding adjacent counterflowing crossflow channels 60 will be referenced as including a first crossflow channel 60, which connects to feed channel 81, and a second crossflow channel 60, which connects to outlet channel 82.

Feed and outlet channel configuration 121 generally includes a feed channel 81 and an adjacent or neighboring outlet channel 82. Both may be disposed near an edge of inner shroud segment 35, for example, first and second circumferential edges 48, 50. Feed channel 81 may extend between an inlet 91 formed on an exterior surface of inner shroud segment 35 and a connection made with the first crossflow channel 60 of the paired crossflow channels 60. According to preferred embodiments, inlet 91 may be formed through outboard face 52 of inner shroud segment 35 so that inlet 91 fluidly communicates with cavity 37 and/or outboard cavity 71 of inner shroud segment 35. For example, inlet 91 may be formed on inward side 75 of circumferential rail 72 of first circumferential edge 48. As another example, when feed and outlet channel configuration 121 occurs on the opposite side of inner shroud segment 35, inlet 91 may be formed on inward side 75 of circumferential rail 72 of second circumferential edge 50. In regard to outlet channel 82, it may extend between a connection made with the second crossflow channel 60 of paired crossflow channels and an outlet 92 formed on an exterior surface of inner shroud segment 35. For example, outlet 92 may be formed on first circumferential edge 48. When feed and outlet channel configuration 121 occurs on the opposite side of inner shroud segment 35, outlet 92 may be formed on second circumferential edge 50.

In accordance with example embodiments, certain configurational attributes of feed and outlet channel configuration 121 will now be described. For purposes of description, the shape of feed and outlet channels 81, 82 within such embodiments will be described primarily in two ways. With the first of these, an outer radially or "outboard perspective" will be referenced. As used herein, an "outboard perspective" is intended as a view looking in an inboard direction from a position directly outboard of the feature being described. This perspective will be useful in describing how the paths of feed channel 81 and outlet channels 82 are shaped in the axial and circumferential directions 30, 32. The second way to describe the configuration will be with reference to relative changes in radial position.

With that in mind, according to preferred embodiments, feed channel 81 initially slants in an inboard direction from a radially elevated initial position at inlet 91 to the approximate radial level of floor 74 or crossflow channels 60, which may be near inboard face 54. From the outboard perspective, this first slanting section may be substantially linear and aligned with the circumferential direction 32. From the outboard perspective, feed channel 81 may continue via a curving or looping second section that turns the flow of coolant approximately 180° before feed channel 81 connects with upstream end 61 of first crossflow channel 60. Thus, while the initial flow direction in feed channel 81 is directed toward first circumferential edge 48, at the connection that feed channel 81 makes with first crossflow channel 60, the flow direction is circumferentially reversed so that the flow of coolant is now being directed toward second circumferential edge 50. From the outboard perspective, in making this 180° turn, the curvature of feed channel 81 bows outward toward outlet channel 82. From the outboard perspective, this second or bowed section 123 is configured to undercut a section of outlet channel 82. More specifically, again, from the outboard perspective, bowed section 123 of feed channel 81 axially and circumferentially overlaps a section of outlet channel 82, while being radially offset therefrom in the inboard direction.

From the outboard perspective, upstream end 61 of first crossflow channel 60 may be positioned to overlap axially with inlet 91, while being radially offset therefrom in the inboard direction. Thus, from the outboard perspective, as shown most clearly in FIG. 12, feed channel 81 may continue to loop around—almost completing an entire circle—before reversing its curvature and straightening out so to connect with upstream end 61 at a position that axially overlaps with inlet 91.

According to preferred embodiments, a first section of outlet channel 82 may slant in an outboard direction from the connection outlet channel 82 makes with downstream end 62 of crossflow channel 60. More specifically, as shown most clearly in FIG. 13, outlet channel 82 may include a first or outboard slanting section 125 that carries coolant from an initial radial position that is near inboard face 54 to a raised outboard position that is outboard of the radial midpoint of circumferential rail 72. After outboard slanting section 125, a second section of outlet channel 82 may then flatten out radially and extend toward outlet 92, which may be disposed on first circumferential edge 48. As will be appreciated, outboard slanting section 125 provides the inner radially space necessary for the bowed section 123 of feed channel 81 to undercut outlet channel 82. From the outboard perspective, as shown most clearly in FIG. 11, outlet channel 82 may maintain a linear path between downstream end 62 and outlet 92. This linear path may be aligned approximately with the circumferential direction and/or provide a continuation of the linear path defined by second crossflow channel 60.

As a further feature, inward side 75 of circumferential rail 72 may include a corrugated configuration 130 with alternating ridges 131 and valleys 133, which, as will be seen, may be configured to correspond to the placement of feed and outlet channels 81, 82 with feed and outlet channel configurations 121. Generally, ridges 131 and valleys 133 may extend in the circumferential direction and slant in the outboard direction along a contour of inward side 75 of circumferential rail 72. As shown most clearly in FIG. 15, a circumferentially extending ridge 131 may be formed about each of the outboard slanting sections 125 of outlet channels 82. Specifically, each ridge 131 may be configured to correspond to the shape of outboard slanting section 125 of one of the outlet channels 82, generally wrapping around the outer radial half of this section. Between each of the neighboring ridges 131, a circumferentially extending depression or valley 133 may be formed, within which inlet 91 for feed channel 81 may be located. As indicated in the several figures, corrugated configuration 130 may be repeated along inward side 75 for each of the circumferential rails 72 so that it corresponds with the repetition of feed and outlet channel configuration 121. For descriptive purposes, it will be appreciated that within the corrugated configuration 130, the "ridge" portion is a feature that juts in an outboard direction, while the "valley" portion is a cut away portion or depression made in the inboard direction.

The advantages of corrugated configuration 130 include the removal of excess material while maintaining the structural robustness of the component. Further, corrugated configuration 130 provides benefits related to enabling or enhancing aspects of feed and outlet channel configuration 121. For example, ridge 131 enables outboard slanting section 125 of outlet channels 82 to extend circumferentially at a steeper angle, which produces the space to the inboard side of it for feed channel 81 to curl under it in the manner discussed above. As another example, valleys 133 enable the positioning of inlet 91 at a lower radial height, which also facilitates feed channel 81 curling under outlet channel 82 in the desired manner. Further, the lower radial height of inlet 91 results in a shorter length of feed channel 81, which decreases aerodynamic losses.

Figure 16:
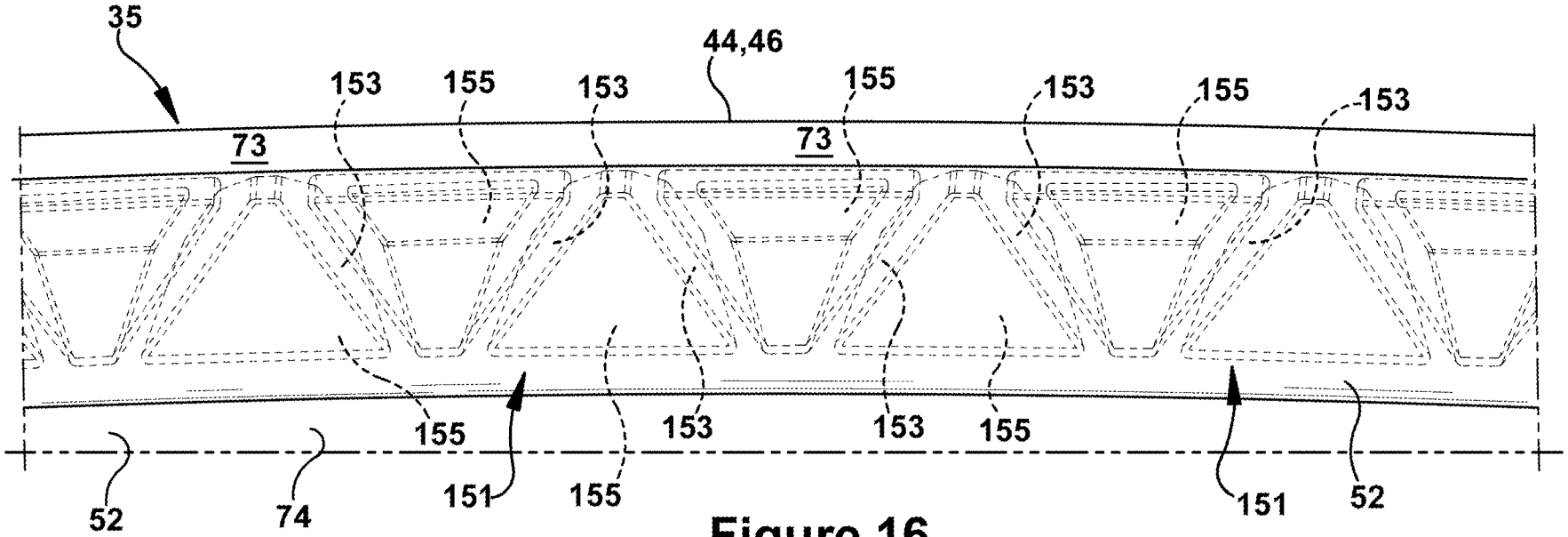
FIG. 16 is a transparent view of a structural configuration of a leading or trailing edge rail in accordance with an exemplary configuration of the present disclosure.
Figure 17:
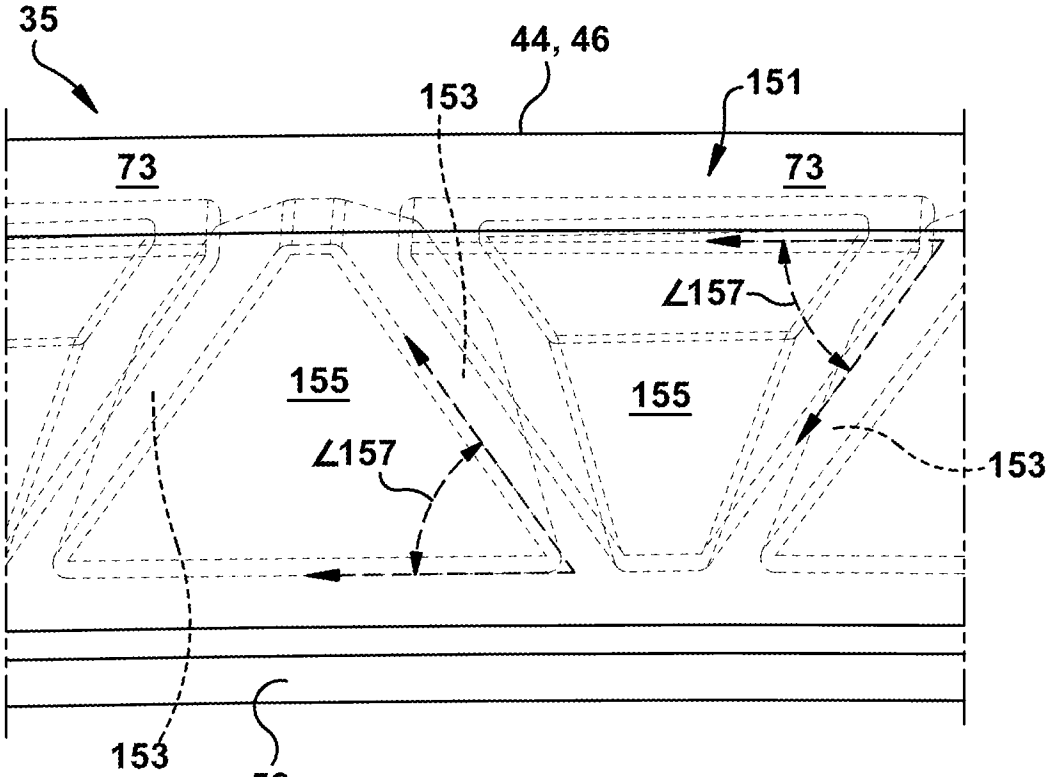
FIG. 17 is a transparent view of a structural configuration of a leading or trailing edge rail in accordance with an exemplary configuration of the present disclosure.

With reference now to FIGS. 16 and 17, structural configurations will be disclosed that, for example, may be used within to support leading or trailing axial rails 73. FIG. 16 is a transparent view of an exemplary structural configuration of axial rails 73, i.e., the rails that are formed along either leading or trailing edges 44, 46, while FIG. 17 provides an enhanced view of particular aspects of that structural configuration. According to exemplary embodiments, the structural configuration may include a truss-like arrangement or structure (or "truss structure") 151 that is formed within the interior of axial rail 73 for structural support. As illustrated, truss structure 151 may include a repeating arrangement of members 153 having a triangular shape, which allows for the removal of material to form a repeating triangular hollow portion 155 from axial rail 73. The triangular shape may extend between an outboard edge of the axial rail and an inboard edge of the axial rail. The members 153 may include a slanting member that slants between the outboard edge and the inboard edge of axial rail 73. The angle 157 that the slanting member makes with each edge of the truss structure 151 may be 60° or less. According to preferred embodiments, the angle 157 that the slanting member makes with each edge of the truss structure 151 may be 45° or less.

It has been found that truss structure 151 at axial rail 73 allows for the removal of significant material, i.e., the triangular hollow portions, which result in weight and cost savings, while also maintaining acceptable structural rigidity and support. Further, as discussed more below, truss structure 151 is configured such that it may be produced efficiently by additive manufacturing processes in accordance with necessary requirements and without the limitations of a minimum wall thickness, as would be required for casting.

The above-described surface and interior configurations and cooling channel embodiments for hot gas path components, e.g., inner shroud segments, may be formed or constructed via any conventional manufacturing technique, including electrical discharge machining, drilling, casting, additive manufacturing, a combination thereof, or any other technique. As will now be discussed, certain aspects the above-disclosed embodiments are particularly configured to provide constructability advantages for expedited and cost-effective manufacture via additive manufacturing processes.

For example, with certain additive manufacturing process, such as selective deposition additive manufacturing, material is deposited on previously formed or deposited portions of the component, to progressively build a component along a build direction (which may be substantially vertical) in a self-supporting manner. In selective deposition additive manufacture, material can be deposited so that newly-deposited material overhangs the supporting material by a limited extent. Such newly-deposited material is said to overhang by an "overhang angle", typically measured from the vertical. It has been found that, in order to reliably and accurately manufacture a self-supporting structure in selective deposition additive manufacturing, an overhang angle of an overhanging part should be no more than 60° from the vertical axis. The surface finish of the component may be affected by the overhang angle of the component, such that a smaller overhang angle, such as less than 45° from the vertical axis, generally results in a better surface finish. Surface finish may affect the life of a hot gas component like an inner shroud segment, therefore this is an important consideration. Specifically, for a component which will endure high stresses of the hot gas path, a smaller angle from the vertical axis may be required in order for it to have an acceptable surface finish and therefore an acceptable component life.

Embodiments of inner shroud segment 35 disclosed herein are configured so that typical build directions result in maximum overhang angles of approximately 60° or, according to other alternatives, maximum overhang angles of approximately 45°. For example, assuming that the lengthwise axis of the inner shroud segment is aligned with a vertical build direction, the implied overhang angles for constructing trough 101 given the ranges provided herein for first and second angles 108, 109 would result in a shallow overhang angles of less than less 60° and/or 45°. This is also true if the widthwise axis of the inner shroud segment is instead the axis chosen for alignment with a vertical build direction. As another example, assuming that the lengthwise axis of the inner shroud segment is aligned with a vertical build direction, the implied overhang angles for constructing the angled members 153 of truss structure 151 given the ranges provided herein for angle 157 would result in a shallow overhang angles of less than less 60° and/or less than 45°.

As one of ordinary skill in the art will appreciate, the many varying features and configurations described above in relation to the several exemplary embodiments may be further selectively applied to form the other possible embodiments of the present disclosure. For the sake of brevity and taking into account the abilities of one of ordinary skill in the art, each of the possible iterations is not provided or discussed in detail, though all combinations and possible embodiments embraced by the several claims below or otherwise are intended to be part of the instant application. In addition, from the above description of several exemplary embodiments of the invention, those skilled in the art will perceive improvements, changes and modifications. Such improvements, changes and modifications within the skill of the art are also intended to be covered by the appended claims. Further, it should be apparent that the foregoing relates only to the described embodiments of the present application and that numerous changes and modifications may be made herein without departing from the spirit and scope of the application as defined by the following claims and the equivalents thereof.

That which is claimed:

1. A turbine of a gas turbine engine, the turbine comprising a stationary shroud ring having an inner shroud segment, the inner shroud segment comprising:

opposed inboard and outboard faces, wherein the inboard face is directed toward a hot gas path defined through the turbine, and the outboard face is directed away from the hot gas path;

a first circumferential rail, a second circumferential rail, and axial rails that collectively surround a floor of the inner shroud segment;

a cooling configuration in which cooling channels are configured to receive and direct a coolant through an interior of the inner shroud segment, wherein the cooling channels comprise a crossflow channel, wherein the crossflow channel extends lengthwise from an upstream end to a downstream end through the floor of the inner shroud segment; and troughs formed within the outboard face, each of the troughs being positioned between and extending lengthwise in parallel to a pair of the crossflow channels;

wherein each of the troughs elongates between ends that define a length of the trough; and wherein:

a width of the trough is defined as a distance in the axial direction between opposing sides of the trough;

a depth of the trough is defined as a distance in the radial direction between a surrounding surface of the floor and a lowest point within the trough;

wherein each of the troughs comprises a width and depth that varies along the length of the trough.

2. The turbine according to claim 1, wherein the stationary shroud ring includes circumferentially stacked shroud segments in which an outer shroud segment is formed outboard of the inner shroud segment;

wherein the stationary shroud ring is formed about a row of rotor blades;

wherein the cooling configuration of the inner shroud segment comprises a plurality of the crossflow channels; and wherein the each of the plurality of crossflow channels comprises:

a junction point located between the upstream and downstream ends that divides the respective crossflow channel lengthwise into upstream and downstream sections, the upstream section extending between the upstream end and the junction point and the downstream section extending between the junction point and the downstream end; and a cross-sectional flow area that varies lengthwise such that a cross-sectional flow area of the upstream section continuously decreases from the upstream end to the junction point, and a cross-sectional flow area of the downstream section continuously increases from the junction point to the downstream end.

3. The turbine according to claim 2, wherein:

the decreasing of the cross-sectional flow area of the upstream section comprises a cross-sectional flow area at the junction point being less than 50% of a cross-sectional flow area at the upstream end; and the increasing of the cross-sectional flow area of the downstream section comprises the cross-sectional flow area at the junction point being less than 50% of a cross-sectional flow area at the downstream end.

4. The turbine according to claim 2, wherein:

the decreasing of the cross-sectional flow area of the upstream section comprises a cross-sectional flow area at the junction point being less than 65% of a cross-sectional flow area at the upstream end; and the increasing of the cross-sectional flow area of the downstream section comprises the cross-sectional flow area at the junction point being less than 65% of a cross-sectional flow area at the downstream end.

5. The turbine according to claim 1, wherein the first circumferential rail includes a first inward side and the second circumferential rail includes a second inward side, wherein the upstream end of the crossflow channel is upstream from at least a portion of the first inward side, and wherein the downstream end of the crossflow channel is downstream from at least a portion of the second inward side.

6. The turbine according to claim 2, wherein the inner shroud segment comprises:

opposed leading and trailing edges;

opposed first and second circumferential edges; and wherein the turbine comprises a center axis relative to which axial, radial, and circumferential directions are defined, the inner shroud segment being oriented such that: the leading and trailing edges are offset in the axial direction, with the offset therebetween defining a width of the inner shroud segment;

the first and second circumferential edges are offset in the circumferential direction, with the offset therebetween defining a length of the inner shroud segment; and the inboard and outboard faces are offset in the radial direction, with the offset therebetween defining a height of the inner shroud segment.

7. The turbine according to claim 6, wherein, between the upstream and downstream ends, the crossflow channel maintains a constant offset from the inboard face; wherein the cooling configuration comprises a plurality of crossflow channels and, for each of the crossflow channels, the cooling configuration further comprises a feed channel and an outlet channel;

wherein:

the feed channel extends between an inlet formed on an exterior surface of the inner shroud segment and the upstream end of the crossflow channel; and the outlet channel extends between the downstream end of the crossflow channel and an outlet formed on an exterior surface of the inner shroud segment.

8. The turbine according to claim 6, wherein the decreasing of the cross-sectional flow area of the upstream section comprises narrowing of the upstream section in the axial direction, and wherein the increasing of the cross-sectional flow area of the downstream section comprises widening of the downstream section in the axial direction;

wherein the crossflow channel forms an angle with the circumferential direction that is less than 15°; and wherein the crossflow channel extends across at least 60% of the length of the inner shroud segment.

9. The turbine according to claim 6, wherein the crossflow channel forms an angle with the circumferential direction that is less than 5°; and wherein the crossflow channel extends across at least 75% of the length of the inner shroud segment.

10. The turbine according to claim 6, wherein:

a length of the crossflow channel is defined as a distance in the circumferential direction between the upstream end and the downstream end of the crossflow channel;

a width of the crossflow channel is defined as a distance in the axial direction between a first side and a second side of the crossflow channel; and a height of the crossflow channel is defined as a distance in the radial direction between a floor and a ceiling of the crossflow channel;

wherein:

the decreasing of the cross-sectional flow area of the upstream section comprises a tapering in the width of the crossflow channel;

the increasing of the cross-sectional flow area of the downstream section comprises an enlarging in the width of the crossflow channel; and the height of the crossflow channel is constant between the upstream and downstream ends of the crossflow channel.

11. The turbine according to claim 10, wherein the junction point is located within a range of between 45% and 55% of the length of the crossflow channel;

wherein:

the upstream end of the crossflow channel is disposed no further from the first circumferential edge than a distance equal to 20% of the length of the inner shroud segment; and the downstream end of the crossflow channel is disposed no further from the second circumferential edge than a distance equal to 20% of the length of the inner shroud segment.

12. The turbine according to claim 10, wherein the junction point is located within a range of between 35% and 65% of the length of the crossflow channel;

wherein:

the upstream end of the crossflow channel is disposed no further from the first circumferential edge than a distance equal to 20% of the length of the inner shroud segment; and the downstream end of the crossflow channel is disposed no further from the second circumferential edge than a distance equal to 20% of the length of the inner shroud segment.

13. The turbine according to claim 1, wherein the cooling configuration of the inner shroud segment comprises ten or more of the crossflow channels having lengthwise axes which are parallel with respect to each other; and wherein the ten or more of the crossflow channels comprise an alternating counterflow arrangement in which adjacent ones of the ten or more of the crossflow channels are oppositely oriented in the circumferential direction.

14. A turbine of a gas turbine engine, the turbine comprising a stationary shroud ring having an inner shroud segment, a center axis relative to which axial, radial, and circumferential directions are defined, the inner shroud segment comprising:

a first circumferential rail, a second circumferential rail, and axial rails that collectively surround a floor of the inner shroud segment;

a cooling configuration in which cooling channels are configured to receive and direct a coolant through an interior of the inner shroud segment, wherein the cooling channels comprise a crossflow channel; and wherein the crossflow channel:

extends lengthwise from an upstream end to a downstream end, wherein the crossflow channel extends through the floor of the inner shroud segment;

comprises a junction point located between the upstream and downstream ends that divides the crossflow channel lengthwise into upstream and downstream sections, the upstream section extending between the upstream end and the junction point and the downstream section extending between the junction point and the downstream end; and comprises a cross-sectional flow area that varies lengthwise such that a cross-sectional flow area of the upstream section decreases from the upstream end to the junction point, and a cross-sectional flow area of the downstream section increases from the junction point to the downstream end;

troughs formed within an outboard face of the inner shroud segment, each of the troughs being positioned between and extending lengthwise in parallel to a pair of the crossflow channels;

wherein each of the troughs elongates between ends that define a length of the trough; and wherein:

a width of the trough is defined as a distance in the axial direction between opposing sides of the trough;

a depth of the trough is defined as a distance in the radial direction between a surrounding surface of the floor and a lowest point within the trough;

wherein each of the troughs comprise a width and depth that varies along the length of the trough.

15. The turbine according to claim 14, wherein each of the troughs widens and deepens as the trough extends inwardly from the ends toward a dividing line that marks a greatest width and depth of the trough; and wherein the widening and deepening of each of the troughs is configured to correspond in shape to the narrowing of the pair of crossflow channels that flank the trough.

16. The turbine according to claim 15, wherein the widening and deepening of each of the troughs correspond to the narrowing of the crossflow channels such that a constant distance is maintained between the sides of the trough and the sides of the pair of crossflow channels that flank the trough; and wherein the trough extends across at least 50% of the length of the inner shroud segment.

17. The turbine according to claim 15, wherein the dividing line of each of the troughs aligns circumferentially with the junction points of the crossflow channels of the pair of crossflow channels that flank the trough; and wherein the depth and width of each of the troughs varies such that the trough deepens and widens, respectively, as the trough extends inwardly from the ends toward the dividing line.

18. The turbine according to claim 15, wherein each of the troughs widens from the ends according to an angle of between 5° and 15° that is formed between the opposing sides of the trough;

wherein each of the troughs deepens from the opposing sides according to an angle of descent of between 25° and 45°; and wherein each of the troughs extends across at least 65% of the length of the inner shroud segment.

19. A turbine of a gas turbine engine, the turbine comprising a stationary shroud ring having an inner shroud segment that includes:

a cooling configuration in which cooling channels are configured to receive and direct a coolant through an interior of the inner shroud segment, wherein the cooling channels comprise two parallel crossflow channels; and a trough formed within an outboard face, the trough being positioned between and extending lengthwise in parallel to the two crossflow channels;

wherein each of the two crossflow channels:

extends lengthwise between an upstream end and a downstream end;

comprises a junction point located between the upstream and downstream ends that divides the crossflow channel lengthwise into upstream and downstream sections, the junction point comprising a neck at which the crossflow channel has a minimum cross-sectional flow area; and comprises a cross-sectional flow area that varies lengthwise such that a cross-sectional flow area of the upstream section decreases between the upstream end and the junction point, and a cross-sectional flow area of the downstream section increases between the junction point and the downstream end;

wherein the decreasing of the cross-sectional flow area of the upstream section comprises a cross-sectional flow area at the junction point being less than 65% of a cross-sectional flow area at the upstream end, and the increasing of the cross-sectional flow area of the downstream section comprises the cross-sectional flow area at the junction point being less than 65% of a cross-sectional flow area at the downstream end;

wherein the trough widens and deepens as the trough extends inwardly from opposing ends toward a dividing line that marks a greatest width and depth of the trough; and wherein the widening and deepening of the trough are configured to correspond in shape to the narrowing of the two crossflow channels that flank the trough.

20. The turbine according to claim 19, wherein the widening and deepening of the trough correspond to the narrowing of the two crossflow channels such that a constant distance is maintained between sides of the trough and sides of the two crossflow channels that flank the trough;

wherein the trough and the two crossflow channels each extends across at least 50% of the length of the inner shroud segment; and wherein the dividing line of the trough aligns with the junction points of the two crossflow channels that flank the trough.

* * * * *